US012503145B2

(12) United States Patent
Allen et al.

(10) Patent No.: US 12,503,145 B2
(45) Date of Patent: Dec. 23, 2025

(54) SYSTEM AND METHOD FOR VIRTUAL BLOCK OPERATIONAL STATUS CONTROL WITH LONG BLOCK TIME DELAY

(71) Applicant: BNSF Railway Company, Fort Worth, TX (US)

(72) Inventors: Jeffrey R. Allen, Olathe, KS (US); Michael E. Ramolt, Shawnee, KS (US); Kent R. Shue, Bonner Springs, KS (US); Brent A. Russell, Olathe, KS (US)

(73) Assignee: BNSF Railway Company, Fort Worth, TX (US)

( * ) Notice: Subject to any disclaimer, the term of this patent is extended or adjusted under 35 U.S.C. 154(b) by 513 days.

(21) Appl. No.: 18/161,559

(22) Filed: Jan. 30, 2023

(65) Prior Publication Data

US 2023/0166780 A1 Jun. 1, 2023

Related U.S. Application Data

(60) Continuation-in-part of application No. 17/542,263, filed on Dec. 3, 2021, now Pat. No. 11,767,041,
(Continued)

(51) Int. Cl.
*B61L 11/08* (2006.01)
*B61L 1/18* (2006.01)
(Continued)

(52) U.S. Cl.
CPC ..... *B61L 11/08* (2013.01); *B61L 1/188* (2013.01); *B61L 7/088* (2013.01); *B61L 21/10* (2013.01);
(Continued)

(58) Field of Classification Search
CPC ..... B61L 11/08; B61L 1/188; B61L 7/088; B61L 21/10; B61L 23/168; B61L 3/221; B61L 23/044; B61L 2011/086
See application file for complete search history.

(56) References Cited

U.S. PATENT DOCUMENTS 5,332,180 A 7/1994 Peterson et al.
5,398,894 A * 3/1995 Pascoe ..... B61L 21/10 246/62
(Continued)

FOREIGN PATENT DOCUMENTS

CN 110603185 A * 12/2019 ..... B61L 11/08
EP 0638469 A2 2/1995
(Continued)

OTHER PUBLICATIONS

Paola Pellegrini, et al., "Real Time Railway Traffic Management Modeling Track Circuits", Article, Sep. 2012, 13 pages.
(Continued)

*Primary Examiner* — Jason C Smith
(74) *Attorney, Agent, or Firm* — Whitaker Chalk Swindle & Schwartz PLLC; Enrique Sanchez, Jr.

(57) ABSTRACT

A system and method for virtual block operational status control with long block time delay is presented. The present disclosure can advantageously increase the capacity and safety of the existing railroad track infrastructure used by the railroads by determining whether a virtual block is healthy or unhealthy. The long block mode can provide a coarse granularity on the presence of a train. In virtual block mode, the system can implement a finer granularity so the virtual aspects of the sub blocks can be realized. The present disclosure provides a long block mode that can provide the system an opportunity to analyze the potential tradeoffs between granularity and reliability by determining which mode (virtual block or long block) is best utilized in a given
(Continued)

| | | | situation. The system can operate by default in long block mode and ignore the virtual block capabilities until absolutely needed.

20 Claims, 10 Drawing Sheets

Related U.S. Application Data which is a continuation of application No. 17/302,524, filed on May 5, 2021, now Pat. No. 11,230,307, which is a continuation of application No. 17/247,303, filed on Dec. 7, 2020, now Pat. No. 11,104,361, which is a division of application No. 15/965,680, filed on Apr. 27, 2018, now Pat. No. 10,894,550.

(60) Provisional application No. 62/502,224, filed on May 5, 2017.

(51) Int. Cl.

| | |
|---|---|
| ***B61L 3/22*** | (2006.01) |
| ***B61L 7/08*** | (2006.01) |
| ***B61L 21/10*** | (2006.01) |
| ***B61L 23/04*** | (2006.01) |
| ***B61L 23/16*** | (2006.01) |

(52) U.S. Cl.

CPC ..... *B61L 23/168* (2013.01); *B61L 3/221* (2013.01); *B61L 2011/086* (2013.01); *B61L 23/044* (2013.01)

(56) References Cited

U.S. PATENT DOCUMENTS

| | | | | |
|---|---|---|---|---|
| 5,950,966 | A | 9/1999 | Hungate et al. | |
| 6,655,639 | B2 * | 12/2003 | Grappone | B61L 23/041 246/120 |
| 6,666,411 | B1 | 12/2003 | Hart et al. | |
| 7,222,003 | B2 * | 5/2007 | Stull | B61L 25/021 701/19 |
| 7,954,770 | B2 | 6/2011 | Tomlinson, Jr. et al. | |
| 8,613,410 | B2 | 12/2013 | Bohlmann et al. | |
| 8,996,208 | B2 | 3/2015 | Shoppa et al. | |
| 9,102,341 | B2 * | 8/2015 | Malone, Jr. | B61L 1/187 |
| 9,162,691 | B2 * | 10/2015 | Polivka | B61L 3/243 |
| 9,718,487 | B2 | 8/2017 | Ghaly | |
| 9,925,994 | B2 * | 3/2018 | Ferrari | B61L 15/0081 |
| 10,081,379 | B2 * | 9/2018 | Kull | B61L 27/53 |
| 10,507,852 | B2 | 12/2019 | Schmidt et al. | |
| 11,001,282 | B2 * | 5/2021 | Tsujita | B61L 3/12 |
| 11,021,178 | B2 * | 6/2021 | Ghaly | B61L 23/18 |
| 11,827,256 | B1 * | 11/2023 | Sapp | B61L 15/0018 |
| 12,330,701 | B2 * | 6/2025 | McKenna | B61L 27/40 |
| 2003/0112131 | A1 | 6/2003 | Mcallister | |
| 2005/0075765 | A1 | 4/2005 | Oguma et al. | |
| 2007/0078574 | A1 | 4/2007 | Davenport | |
| 2013/0218375 | A1 | 8/2013 | Ning et al. | |
| 2013/0334373 | A1 | 12/2013 | Malone, Jr. et al. | |
| 2016/0107664 | A1 | 4/2016 | Kull | |
| 2017/0113707 | A1 | 4/2017 | Ghaly | |
| 2018/0319413 | A1 * | 11/2018 | Specht | B61L 23/168 |
| 2018/0327008 | A1 | 11/2018 | Kindt et al. | |
| 2019/0168788 | A1 * | 6/2019 | Ghaly | B61L 27/20 |
| 2020/0207384 | A1 * | 7/2020 | Dick | B61L 3/02 |
| 2021/0139059 | A1 * | 5/2021 | Schmidt | B61L 1/188 |
| 2022/0185350 | A1 * | 6/2022 | Kindt | B61L 1/18 |
| 2023/0166780 | A1 * | 6/2023 | Allen | B61L 23/168 246/38 |
| 2024/0253677 | A1 * | 8/2024 | Sapp | B61L 25/025 |
| 2025/0033679 | A1 * | 1/2025 | Allen | B61L 23/168 |

FOREIGN PATENT DOCUMENTS

| | | | | |
|---|---|---|---|---|
| JP | 0532166 | A | 2/1993 | |
| JP | 101054 | A | 1/1998 | |
| JP | 2005145089 | A | 6/2005 | |
| WO | 2015180902 | A1 | 12/2015 | |
| WO | WO-2024163080 | A1 * | 8/2024 | B61L 23/16 |

OTHER PUBLICATIONS

Haifeng Song, Tuo Shen, Weiyang Wang, Train-centric communication-based close proximity driving train movement authority system, Jun. 7, 2018.

* cited by examiner

| | |
|---|---|
| Onboard | $G_0+C_1$ $D_1$ $A_1B_1C_1D_1E_1F_1G_1H_1$ $E_1$ $F_1+B_1$ $G_1+C_1$ $D_2$ $A_2B_2C_2D_2E_2F_2G_2H_2$ $E_2$ $F_2+B_3$ $G_2+C_3$ $D_3$ $A_3B_3C_3D_3E_3F_3G_3H_3$ $E_3$ $F_3+B_4$ |
| | 1 1 1

| Onboard | $G_0$+$C_1$ $D_1$ $A_1B_1C_1D_1E_1F_1G_1H_1$ $E_1$ $F_1$+$B_1$ $G_1$+$C_1$ $D_2$ $A_2B_2C_2D_2E_2F_2G_2H_2$ $E_2$ $F_2$+$B_3$ $G_2$+$C_3$ $D_3$ $A_3B_3C_3D_3E_3F_3G_3H_3$ $E_3$ $F_3$+$B_4$ |
|---|---|
| | 1 1 1 1 1 1 1 1 1 1 |
| PTC VB Haz | -1 1 1 1 1 1- -1 1 1 1 1 1- -1 1 1 1 1- |
| VB | 1 1 1 1 1 1 1 1 1 1 1 1 1 1 1 1 1 1 1 1 1 1 1 1 1 1 1 1 1 1 1 0 |
| | Mode LB WB - EB LB Mode LB WB - EB LB Mode LB WB - EB LB Mode |
| PTC Auth | 00000-00000 00001-00000 00001-00000 |
| EC Rate | West - East West - East West - East |
| TX | 1,2 - 1,2 TX 1 - 1,2 TX 1 - 1 |
| RX | 1,2 - 1 RX 1,2 - 1 RX 1,2 - NC |
| PTC LB Haz | WT 1------1 ET WT 1------1 ET WT 1------0 ET |

| Onboard | $G_0+C_1$ $D_1$ $A_1B_1C_1D_1E_1F_1G_1H_1$ $E_1$ $F_1+B_1$ $G_1+C_1$ $D_2$ $A_2B_2C_2D_2E_2F_2G_2H_2$ $E_2$ $F_2+B_3$ $G_2+C_3$ $D_3$ $A_3B_3C_3D_3E_3F_3G_3H_3$ $E_3$ $F_3+B_4$ |
|---|---|
| | 1 1 1 1 1 1 1 1 1 1 |
| PTC VB Haz | -1 1 1 1 1 1- -1 1 1 1 1 1- -1 1 1 1 1 1- |
| VB | 1 1 1 1 1 1 1 1 1 1 1 1 1 1 1 1 1 1 1 1 1 1 1 1 1 1 1 1 1 1 1 0 |
| | Mode LB WB - EB LB Mode LB WB - EB LB Mode LB WB - EB VB Mode |
| PTC Auth | 00000-00000 00001-00000 00001-00000 |
| EC Rate | West - East West - East West - East |
| TX | 1,2 - 1,2 TX 1 - 1,2 TX 1 - 1 |
| RX | 1,2 - 1 RX 1,2 - 1 RX 1,2 - NC |
| PTC LB Haz | WT 1------1 ET WT 1------1 ET WT 1------1 ET |

| Onboard | $G_0$+$C_1$ $D_1$ $A_1B_1C_1D_1E_1F_1G_1H_1$ $E_1$ $F_1$+$B_1$ $G_1$+$C_1$ $D_2$ $A_2B_2C_2D_2E_2F_2G_2H_2$ $E_2$ $F_2$+$B_3$ $G_2$+$C_3$ $D_3$ $A_3B_3C_3D_3E_3F_3G_3H_3$ $E_3$ $F_3$+$B_4$ |
|---|---|
| | 1 1 1 1 1 1 1 1 1 1 1 1 1 1 |
| PTC VB Haz | -1 1 1 1 1 1- -1 1 1 1 1 1- -1 1 1 1 1 0- |
| VB | 1 1 1 1 1 1 1 1 1 1 1 1 1 1 1 1 1 1 1 1 1 1 1 0 0 |
| | Mode LB WB - EB LB Mode LB WB - EB LB Mode LB WB - EB VB Mode |
| PTC Auth | 00000-00000 00001-00000 00001-00000 |
| EC Rate | West - East West - East West - East |
| TX | 1,2 - 1,2 TX 1 - 1,2 TX 1 - 1 |
| RX | 1,2 - 1 RX 1,2 - 1 RX 1,2 - NC |
| PTC LB Haz | WT 1-------1 ET WT 1-------1 ET WT 1-------1 ET |

| Onboard | $G_0+C_1$ $D_1$ $A_1B_1C_1D_1E_1F_1G_1H_1$ $E_1$ $F_1+B_1$ $G_1+C_1$ $D_2$ $A_2B_2C_2D_2E_2F_2G_2H_2$ $E_2$ $F_2+B_3$ $G_2+C_3$ $D_3$ $A_3B_3C_3D_3E_3F_3G_3H_3$ $E_3$ $F_3+B_4$ |
|---|---|
| | 1 1 1 1 1 1 1 1 1 1 1 1 |
| PTC VB Haz | -1 1 1 1 1 1- -1 1 1 1 1 1- -1 1 1 1 0 1- |
| VB | 1 1 1 1 1 1 1 1 1 1 1 1 1 1 1 1 1 1 1 1 1 1 1 1 0 0 0 |
| | Mode LB WB - EB LB Mode LB WB - EB LB Mode LB WB - EB LB Mode |
| PTC Auth | 00000-00000 00001-00000 00001-00000 |
| EC Rate | West - East West - East West - East |
| TX | 1,2 - 1,2 TX 1 - 1,2 TX 1 - 1 |
| RX | 1,2 - 1 RX 1,2 - 1 RX 1,2 - NC |
| PTC LB Haz | WT 1------1 ET WT 1------1 ET WT 1------1 ET |

| | | | | | | | | | | | | |
|---|---|---|---|---|---|---|---|---|---|---|---|---|
| Onboard | $G_0+C_1$ 1 | $D_1$ 1 | $A_1B_1C_1D_1E_1F_1G_1H_1$ | $E_1$ 1 | $F_1+B_1$ 1 | $G_1+C_1$ 1 | $D_2$ 1 | $A_2B_2C_2D_2E_2F_2G_2H_2$ | $E_2$ 1 | $F_2+B_3$ 1 | $G_2+C_3$ 1 | $D_3$ 1 | $A_3B_3C_3D_3E_3F_3G_3H_3$ | $E_3$ 0 | $F_3+B_4$ 0 |
| PTC VB Haz | -1 1 1 1 1 1- | | | | | | | -1 1 1 1 1 1- | | | | | -1 1 1 0 1 1- | | |
| VB | 1 1 1 1 1 1 1 1 | | | | | | | 1 1 1 1 1 1 1 1 | | | | | 1 1 1 1 0 0 0 0 | | |
| | Mode LB | WB - EB | | LB | Mode | | LB | WB - EB | | LB | Mode | | LB | WB - EB | VB Mode |
| PTC Auth | 00000-00000 | | | | | | | 00001-00000 | | | | | 00001-00000 | | |
| EC Rate | West - East | | | | | | | West - East | | | | | West - East | | |
| TX | 1,2 - 1,2 | | | | | | TX | 1 - 1,2 | | | | TX | 1 - 1 | | |
| RX | 1,2 - 1 | | | | | | RX | 1,2 - 1 | | | | RX | 1,2 - NC | | |
| PTC LB Haz | WT | 1------1 | | ET | | | WT | 1------1 | | ET | | WT | 1------1 | | ET |

| | | | | | | | | | | | | |
|---|---|---|---|---|---|---|---|---|---|---|---|---|
| Onboard | $G_0+C_1$ 1 | $D_1$ 1 | $A_1B_1C_1D_1E_1F_1G_1H_1$ | $E_1$ 1 | $F_1+B_1$ 1 | $G_1+C_1$ 1 | $D_2$ 1 | $A_2B_2C_2D_2E_2F_2G_2H_2$ | $E_2$ 1 | $F_2+B_3$ 1 | $G_2+C_3$ 1 | $D_3$ 0 | $A_3B_3C_3D_3E_3F_3G_3H_3$ | $E_3$ 0 | $F_3+B_4$ 0 |
| PTC VB Haz | -1 1 1 1 1 1- | | | | | | | -1 1 1 1 1 1- | | | | | -1 1 0 0 1 1- | | |
| VB | 1 1 1 1 1 1 1 1 | | | | | | | 1 1 1 1 1 1 1 1 | | | | | 0 0 0 0 0 0 0 0 | | |
| | Mode LB | WB - EB | | LB | Mode | | LB | WB - EB | | LB | Mode | LB | WB - EB | | VB Mode |
| PTC Auth | 00000-00000 | | | | | | | 00001-00000 | | | | | 00000-00000 | | |
| EC Rate | West - East | | | | | | | West - East | | | | | West - East | | |
| TX | 1,2 - 1,2 | | | | | | TX | 1 - 1 | | | | TX | 1 - 1 | | |
| RX | 1,2 - 1 | | | | | | RX | 1,2 - NC | | | | RX | NC - NC | | |
| PTC LB Haz | WT | 1------1 | | ET | | | WT | 1------0 | | ET | | WT | 0------1 | | ET |

| | | | | | | | | | | | | |
|---|---|---|---|---|---|---|---|---|---|---|---|---|
| Onboard | $G_0+C_1$ 1 | $D_1$ 1 | $A_1B_1C_1D_1E_1F_1G_1H_1$ | $E_1$ 1 | $F_1+B_1$ 1 | $G_1+C_1$ 1 | $D_2$ 1 | $A_2B_2C_2D_2E_2F_2G_2H_2$ | $E_2$ 1 | $F_2+B_3$ 1 | $G_2+C_3$ 1 | $D_3$ 0 | $A_3B_3C_3D_3E_3F_3G_3H_3$ | $E_3$ 0 | $F_3+B_4$ 0 |
| PTC VB Haz | -1 1 1 1 1 1- | | | | | | | -1 1 1 1 1 1- | | | | | -1 1 0 0 1 1- | | |
| VB | 1 1 1 1 1 1 1 1 | | | | | | | 1 1 1 1 **0 0 0 0** | | | | | 0 0 0 0 0 0 0 0 | | |
| | Mode LB | WB - EB | | LB | Mode | LB | WB - EB | | LB | Mode | VB | WB - EB | | VB Mode | |
| PTC Auth | 00000-00000 | | | | | | 00001-00000 | | | | | 00000-00000 | | | |
| EC Rate | West - East | | | | | | West - East | | | | | West - East | | | |
| TX | 1,2 - 1,2 | | | | | TX | 1 - 1 | | | | TX | 1 - 1 | | | |
| RX | 1,2 - 1 | | | | | RX | 1,2 - NC | | | | RX | NC - NC | | | |
| PTC LB Haz | WT | 1------1 | | ET | | WT | 1------**0** | | | ET | WT | 1------1 | | ET | |

SYSTEM AND METHOD FOR VIRTUAL BLOCK OPERATIONAL STATUS CONTROL WITH LONG BLOCK TIME DELAY

CROSS-REFERENCE TO RELATED APPLICATIONS

The present application is a Continuation-in-Part of U.S. patent application Ser. No. 17/542,263, filed Dec. 3, 2021, which claims priority to U.S. patent application Ser. No. 17/302,524, filed May 5, 2021, which claims priority to U.S. patent application Ser. No. 17/247,303, filed Dec. 7, 2020, which claims priority to U.S. patent application Ser. No. 15/965,680, filed Apr. 27, 2018, which claims the benefit of U.S. Provisional Application No. 62/502,24, filed May 5, 2017, the entireties of which are incorporated herein by reference for all purposes.

TECHNICAL FIELD

The present invention relates in general to railroad signaling systems and in particular to railroad virtual track block system health signaling.

BACKGROUND

Block signaling is a well-known technique used in railroading to maintain spacing between trains and thereby avoid collisions. Generally, a railroad line is partitioned into track blocks and automatic signals (typically red, yellow, and green lights) are used to control train movement between blocks. For single direction tracks, block signaling allows trains to follow each other with minimal risk of rear end collisions.

However, conventional block signaling systems are subject to at least two significant disadvantages. First, track capacity cannot be increased without additional track infrastructure, such as additional signals and associated control equipment. Second, conventional block signaling systems cannot identify broken rail within an occupied block.

Railroad signal standard practice for the design and function of signal systems is based upon the concept of a vital system. A vital system is often characterized as being failsafe and consistent with the closed-circuit principle. A system is failsafe if the failure of any element of the system causes the system to revert to its safest condition. In the case of railroad wayside systems, failsafe design requires that if any element necessary to the safe and proper operation of the system cannot perform its intended function that the system will revert to the safest condition, A vital system is in conformance with the closed-circuit principle because the components of the system do not share elements which could afford alternative energy or logic paths, as these elements would violate the failsafe principle.

Moving high density block systems transmit voltage and current down a rail to measure rail resistance. When a train approaches a measured rail segment, the axel connecting two wheels effectively shunt the rail circuit, such that the shunt can be used to determine where a train is located with the measured physical blocks. However, a shunt can indicate the location of a train, or the location of a hazard, such as a rail break or other hazard type.

Current Onboard Movement Authority (OMA)-Virtual Block System (VBS) Positive Train Control (PTC) (OMA-VBS PTC) track databases require hazards to be paired with an opposing hazard. Due to limitations, the locomotive onboard computer is unable to perform a logical 'OR' on the virtual track segments, the locomotive onboard can only perform a logical 'AND.' This creates an issue when a train first occupies a physical track circuit. The virtual track circuit segments within the train's own route change to a 'FALSE' state from the near house perspective which, when 'AND'-ed by the onboard computer with the far house perspective of the same virtual track segments, produce a 'FALSE' state for those track segments on the onboard display requiring the train to slow down or stop. These unnecessary slow-downs or stops negatively impact the efficiency of railroad operations.

Virtual block systems are powerful because of the finer granularity over physical blocks for determining the position of a train. However, certain issues can arise because of the greater potential for false positives or health issues at the virtual block level.

SUMMARY

The present disclosure achieves technical advantages as a system and method for virtual block with long block time delay. The present disclosure provides for a system integrated into a practical application with meaningful limitations capable of advantageously increasing the capacity and safety of the existing railroad track infrastructure used by the railroads by determining whether a virtual block is healthy or unhealthy. In one example, long block mode can provide a coarse granularity on the presence of a train. In another example, in virtual block mode, the system can implement a finer granularity so the virtual aspects of the sub blocks can be realized. The present disclosure solves the technological problem of virtual block systems by providing a long block mode that can provide the system an opportunity to analyze the potential tradeoffs between granularity and reliability by determining which mode (virtual block or long block) is best utilized in a given situation. The system can operate by default in long block mode and ignore the virtual block capabilities until absolutely needed.

Accordingly, the present disclosure discloses concepts inextricably tied to computer technology such that the present disclosure, by operating in long block mode by default, provides a technological benefit since if the health status of a virtual block is unknown and a failure occurs, it would likely be too late to prevent a train from entering a hazardous area. The train would have to transition into emergency operation potentially causing additional hazards and damage to the locomotive. Accordingly, the system may not rely on the health status until it is confident in such reliance, as discussed in more detail below. Advantageously, the system can make the decisions prior to broadcasting data to the train. So the onboard computer can remain unchanged, since if the onboard was going to receive any other kind of data, the onboard computer would need to be redesigned—resulting an increased expenditures of money and time. The present disclosure leverages existing infrastructure to increase capacity and safety.

The present disclosure provides a technological solution missing from conventional systems by at least providing, in one embodiment, virtual block health as a condition of the system's ability to use virtual block statuses (e.g., states). For example, certain checks and balances must be put in place before the system is confident in acting on those states. In one embodiment, the system can provide a single-bit discreet status of whether or not virtual block is healthy from the eastbound and westbound perspective of each wayside house. The system can consume that status and can define a current mode of operation for each of those houses. In one embodiment, the system can analyze the trade off to keep a first train moving at full speed while keeping a second train moving at least a slightly larger distance, with the ability to take advantage of the virtual block statuses when available. In particular, if both the vital application software (wayside) and the executive software (onboard) were in virtual block mode, and the system failed into a long block mode (e.g., after a virtual block status was unable to be determined) while a train occupied the first virtual block, additional hazards and restrictions would be required in the train's route in front of the moving train. This would create a significant reduction in velocity as the restriction would be enforced as a full-service application of the train's braking system. By not upgrading the vital application software to virtual block mode until consumable by a following train, the failure mode of the executive software will not result in additional hazards or restrictions in the route in front of the train. The present disclosure can facilitate the additional technological benefits of adding railroad capacity without adding infrastructure, reducing of the maintenance cost of an asset-heavy signal system, and leveraging the heavy investment in existing Positive Train Control (PTC) onboard systems.

The present disclosure improves the performance and functionality of the system by implementing specialized algorithms adapted to determine the true status of a virtual block based on multiple inputs. In one embodiment, when the wayside system vital application software is at rest, and during a first time period (e.g., the first 10 seconds after the first train has entered a physical block), the system can be in long block mode. The normal system can be in rest status of the executive software but is in virtual block mode unless a fault is detected after a train has occupied the physical block. The first time period (e.g., 10-second interval) can provide the executive software time to perform checks to determine whether it is safe to maintain virtual block mode or fail into long block mode.

It is an object of the disclosure to provide a system for virtual block operational status control. It is a further object of the disclosure to provide a method of virtual block operational status control. These and other objects of the disclosure are provided by at least the following embodiments.

In one embodiment, a system for virtual block operational status control, can include: a memory having a first database with operational statuses or specifications related to a vehicle or at least a portion of a railroad track; and a processor operably coupled to the memory and capable of executing machine-readable instructions to perform program steps, the program steps including: generate a plurality of virtual blocks within a physical block; generate a long block within the physical block; operate in a long block mode until a virtual block occupancy is detected; determine whether a first group of virtual blocks from the perspective of a first wayside house are healthy; operate in a virtual block mode, identifying the occupancy of each of the healthy virtual blocks from the first wayside house perspective, when the first group of virtual blocks are healthy; and operate in the long block mode, identifying the occupancy of the long block from the first wayside house perspective, when the first group of virtual blocks are unhealthy. Wherein the first group of virtual blocks are from the eastbound perspective of the first wayside house. The program steps further comprising: determine whether a second group of virtual blocks from the perspective of the first wayside house are healthy. Wherein the second group of virtual blocks are from the westbound perspective of the first wayside house. The program steps further comprising: generate a virtual block health status indication. The program steps further comprising: perform checks over a first time period after the occupancy of a virtual block is detected to determine whether it is safe to maintain virtual block mode. Wherein the first time period is a 10-second interval. Wherein the operation in a virtual block mode can fail into a long block mode when a virtual block becomes unhealthy or its health is undetermined. Wherein the health of a virtual block is represented by a single bit. Wherein the physical block can be a section of track between insulated joints.

In another embodiment, a method of virtual block operational status control, can include: generating, via control logic, a plurality of virtual blocks within a physical block; generating, via the control logic, a long block within the physical block; operating in a long block mode until a virtual block occupancy is detected; determining, via control logic, whether a first group of virtual blocks from the perspective of a first wayside house are healthy; operating in a virtual block mode, identifying the occupancy of each of the healthy virtual blocks from the first wayside house perspective, when the first group of virtual blocks are healthy; and operating in the long block mode, identifying the occupancy of the long block from the first wayside house perspective, when the first group of virtual blocks are unhealthy. Wherein the first group of virtual blocks are from the eastbound perspective of the first wayside house. Further comprising: determining whether a second group of virtual blocks from the perspective of the first wayside house are healthy. Wherein the second group of virtual blocks are from the westbound perspective of the first wayside house. Further comprising: generating a virtual block health status indication. Further comprising: performing checks, via the control logic, over a first time period after the occupancy of a virtual block is detected to determine whether it is safe to maintain virtual block mode. Wherein the first time period is a 10-second interval. Wherein the operation in a virtual block mode can fail into a long block mode when a virtual block becomes unhealthy or its health is undetermined. Wherein the health of a virtual block is represented by a single bit. Wherein the physical block can be a section of track between insulated joints.

BRIEF DESCRIPTION OF THE DRAWINGS

The present disclosure will be readily understood by the following detailed description, taken in conjunction with the accompanying drawings that illustrate, by way of example, the principles of the present disclosure. The drawings illustrate the design and utility of one or more exemplary embodiments of the present disclosure, in which like elements are referred to by like reference numbers or symbols. The objects and elements in the drawings are not necessarily drawn to scale, proportion, or precise positional relationship. Instead, emphasis is focused on illustrating the principles of the present disclosure.

DETAILED DESCRIPTION

Figure 1:
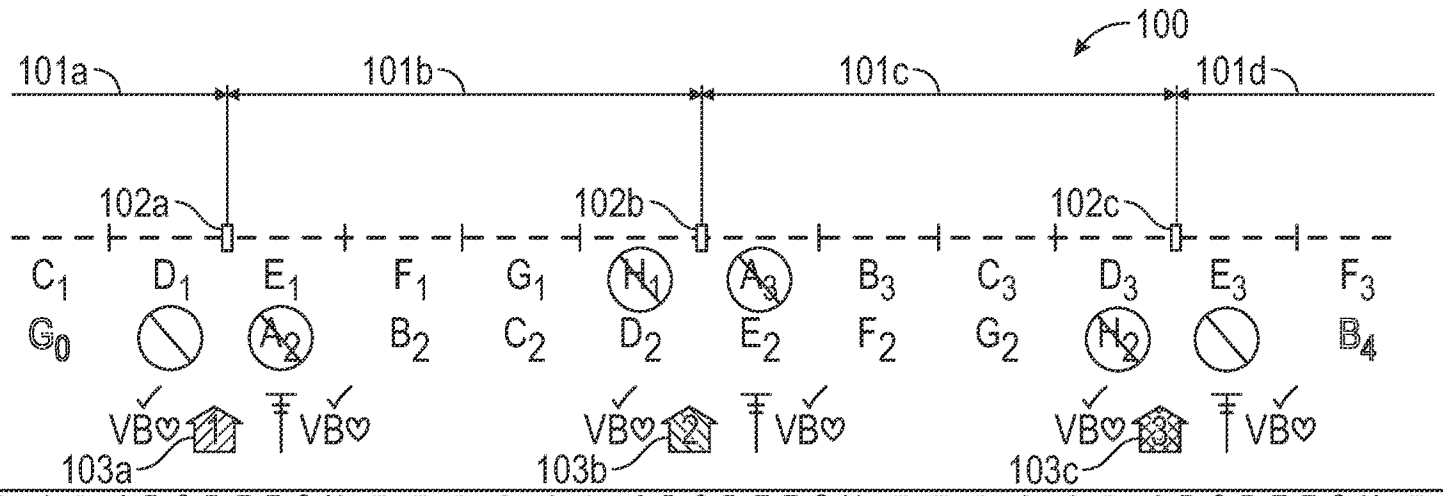
FIG. 1 illustrates a diagram showing a representative number of unoccupied physical railroad track blocks, along with associated signaling (control or wayside) houses, with each physical track block partitioned into a selected number of virtual track blocks, and a listing of certain messages and their corresponding values, in accordance with one or more exemplary embodiments of the present disclosure.

The disclosure presented in the following written description and the various features and advantageous details thereof, are explained more fully with reference to the non-limiting examples included in the accompanying drawings and as detailed in the description. Descriptions of well-known components have been omitted to not unnecessarily obscure the principal features described herein. The examples used in the following description are intended to facilitate an understanding of the ways in which the disclosure can be implemented and practiced. A person of ordinary skill in the art would read this disclosure to mean that any suitable combination of the functionality or exemplary embodiments below could be combined to achieve the subject matter claimed. The disclosure includes either a representative number of species falling within the scope of the genus or structural features common to the members of the genus so that one of ordinary skill in the art can recognize the members of the genus. Accordingly, these examples should not be construed as limiting the scope of the claims.

A person of ordinary skill in the art would understand that any system claims presented herein encompass all of the elements and limitations disclosed therein, and as such, require that each system claim be viewed as a whole. Any reasonably foreseeable items functionally related to the claims are also relevant. The Examiner, after having obtained a thorough understanding of the disclosure and claims of the present application has searched the prior art as disclosed in patents and other published documents, i.e., nonpatent literature. Therefore, as evidenced by issuance of this patent, the prior art fails to disclose or teach the elements and limitations presented in the claims as enabled by the specification and drawings, such that the presented claims are patentable under the applicable laws and rules of this jurisdiction.

Generally, track circuits exist to provide train and broken rail detection and can also convey data from one house to another. In one embodiment, the limits of a two-mile physical track section can be broken up from an adjoining two-mile track section with an insulated joint, such as a clear plastic joint within the rail. Importantly, not all track circuits will be 2 miles, but they can be broken up into segments. Although the embodiments disclosed herein show the physical track broken into 25% increments, any track increment percentage can be used. For example, the concepts disclosed in the present disclosure apply whether the physical track was broken into three 33% track segments, two 50% track segments, irregular track segments, or other suitable track segment. Further, the concept disclosed herein can be applicable regardless of the number of virtual blocks and regardless of the physical block length (e.g., 1-mile, 5-mile, N-mile, etc.).

The system disclosed herein can include a transceiver disposed proximate a wayside house that can transmit a signal down the rail and receive the signal at a second wayside house. When a block is occupied by a train for example, the transmitted signal can be redirected back to the transceiver. In one embodiment, the system can include a transmission circuit that can transmit down one rail through a train axle and receiving the signal on a second rail. A current resistance circuit can determine that actual location of the axel based upon, for example resistance measurements, time delay, or other suitable means. The system can also include a chassis, a vital logic controller that resides in each of wayside house, and a contact for an occupied block, among other components. Additionally, states can be defined within a ladder logic application. The ladder logic can be implemented within the vital controller in the houses and can consume these inputs and determine what is broadcast to the onboard computer. The ladder logic can determine the stick values and bit numbers and can determine virtual block statuses based on inputs from the chassis measurements. The system can also include a PTC interoperable messaging standard that can communicate information from the wayside to the onboard. In another embodiment, the messaging standard can include a portion of the payload that can be defined by a railroad to communicate additional information. The fields, characteristics, and values detailed below can be transmitted as part of this payload.

The virtual block health can be represented by a single bit stored in the vital logic controller or system. Similarly, the ladder logic can include a plurality of health statuses or variables that can be referenced by the system. The virtual block health status can be a variable that has a value of either a logical '0' or a logical '1.' For example, a logical '1' value can represent a healthy block and a logical '0' value can represent an unhealthy block. In another embodiment, during a virtual block health check, the virtual block can be identified as unhealthy. The health of a virtual block can be determined by a plurality of real-time (sub-second processing time) algorithms running and making decisions in the vital logic controllers or remote servers.

For example, upon entry of the track circuit, a train initially shunts the chassis and the system has a moment to determine and analyze the full length track resistances of the rail. In another embodiment, the system can measure the resistance value of the track segment and analyze the resistance value by comparing the measure resistance value with historical resistance values foe the measured track segment, over time. By correlating the measured resistance values with historical resistance values, among others, stored in memory, the system can determine whether the resistance is normal or abnormal based on deviation from the historical values. Such analysis will allow the system to determine whether an abnormal value was registered because the rail is broken or because the rail conditions are different for other reasons, such as wear, local weather, or age. The system can also plot the historic distance curves for the rail segment being analyzed. By way of example, when the system measures a resistance that is 50% of the historic resistance value for a rail segment, e.g., a resistance of three ohms is exactly half the resistance of the physical blocks, the system can determine that two of the virtual blocks are unoccupied and two of the virtual blocks are occupied based on this analysis. However, the system may not have confidence in evaluating measured values against, for example, a known resistance profile unless it is measured at the beginning of the train movement, such that the increased resistance is within a known tolerance (e.g., stored in memory).

The section of track depicted in FIGS. 1-9 represents physical track blocks 101*a*, 11*b*, 11*c*, and 101*d*, with physical track blocks 101*a* and 101*d* partially shown and physical track blocks 101*b* and 101*c* shown in their entirety. Physical track blocks 101*a*-101*d* can be separated by conventional insulated joints 102*a*, 102*b*, and 102*c*. Signal control houses 103*a* (#1), 103*b* (#2), and 103*c* (#3) can be associated with respective insulated joints 102*a*-102*c*. Each signaling house 103 can transmit on the track on both sides of the corresponding insulated joint 102.

In one embodiment, each physical track block 101*a*-101*d* can be partitioned into multiple virtual track segments or "virtual track blocks." In the illustrated embodiment, these virtual track blocks can each represent one-quarter (25%) of each physical track block 101*a*-101*d*, although as discussed above, in alternate embodiments, the number of virtual track blocks per physical track block can vary. In FIGS. 1-9, house #1 (103*a*) can be associated with virtual track blocks $A_1$-$H_1$ ($C_1$-$H_1$ shown), house #2 (103*b*) can be associated with virtual track blocks $A_2$-$H_2$, and house #3 (103*c*) can be associated with virtual track blocks $A_3$-$H_3$ ($A_3$-$F_3$ shown). The track can continue with this convention indefinitely in both directions for additional houses and additional sections of track. For example, house #4 (not shown) can be associated with virtual track blocks $A_4$-$H_4$ ($A_4$-$B_4$ shown). Further, as the virtual block overlapping can theoretically continue indefinitely on either side, only a section of track is presented, wherein house #2 has a full complement of virtual blocks, truncating two of the non-overlapping blocks for house #1 and house #3. These examples are intended to facilitate an understanding of the ways in which the disclosure can be implemented and practiced and should not limit the disclosure to only these examples.

In other words, in the illustrated embodiment, each house 103 can be associated with four (4) virtual track blocks to the left (e.g., west-bound perspective) of the corresponding insulated joint 102 (e.g., virtual track blocks $A_1$-$D_1$) and four (4) virtual track blocks to the right (e.g., east-bound perspective) of the corresponding insulated joint 102 (e.g., virtual track blocks $E_1$-$H_1$), for a total of eight virtual blocks ($A_1$-$H_1$). In this configuration, virtual track blocks can overlap. In one embodiment, the east-bound perspective virtual track blocks for house #1 103*a* can overlap the west-bound perspective virtual track blocks for house #2 103*b*, such that each overlapping virtual block can have two variables to represent it, based on the perspective-house #1 or house #2. For example, virtual track blocks $E_1$-$H_1$ associated with house #1 can overlap with virtual track blocks $A_2$-$D_2$ associated with house #2, such that virtual block $F_1$ (from the house #1 perspective) and virtual block $B_2$ (from the house #2 perspective) correspond to the same virtual block from the perspective of different houses. This provides the advantage of being able to have two views of the same virtual block, so that should one view be blocked (e.g., due to the shunting of a proximate virtual block), the other view can provide a view of the overlapped virtual block. For purposes of this disclosure a particular virtual block can be represented as the virtual block from each house's perspective with a logical AND operator (•) between each variable (e.g., $F_1 \bullet B_2$, $F_2 \bullet B_3$, etc.). In order to leverage the existing onboard, the system can also implement a logical AND of the virtual block statuses. However, in another embodiment, the system can implement a logical OR operation for each virtual block status bit.

The system can measure the track resistance and can take into account many other safety-critical calculations, such as the non-linear track resistance, rail temperature variability, and rail stress variability, among other factors. In one embodiment, the system can also determine a distance of where a track is shunted (e.g., distance from a house 103) and normalize it into one of, for example, four locations within that track circuit (e.g., corresponding with a particular virtual block).

A four-virtual track block can correspond with 25% of the physical length to yield four bits for a specific track circuit—one bit for each virtual block. The system can determine and set the state of those bits (e.g., high (1) or low (0)) based on what is known about the location of the train at that time. The four bits can define the status of these known segments of rail. In another embodiment, the system can define the state of those four virtual blocks from the perspective of two houses as the virtual blocks of two houses will overlap any given track segment. Accordingly, the four bits can represent the state of the, e.g., two-mile track section from the eastern perspective and from the western perspective, so both ends have a specific status. The onboard computer's responsibility can be to act on both of those statuses.

Each FIG. 1-9 includes a table having different message types and corresponding values for each message type based upon the occurrence depicted in the figure. A virtual logic controller can be disposed at each one of the houses 103*a*-103*c* receiving the messages to create virtual blocks. In one embodiment, each of these vital logic controllers can each receive all transmitted or received statuses. In another embodiment, all the statuses that do not indicate PTC or onboard can be received by the vital logic controller. The statuses that indicate PTC or onboard can be outputs that the virtual logic controller is transmitting. The system can measure and provide the statuses as inputs to, for example, ladder logic in a vital logic controller. The statuses that indicate PTC can be transmitted from the vital logic controller to the train. Most of the other statuses can be from the perspective of the vital logic controller. In another embodiment, ladder logic within the vital logic controller can determine how the system consumes those inputs for those conditions, as well as what data is transmitted to the train.

The table in FIGS. 1-9 includes messages and data corresponding to those messages. For example, Onboard represents the virtual block status sent to the onboard computer as explained in more detail below. PTC Virtual Block Hazard (PTC VB Haz) represents a PTC message and the specific payload is a device type of hazard, which is a single bit data. PTC Authentication (PTC Auth) represents a PTC message and the specific payload is a device type of signal authority which is a 5 bit status representing one piece of information. Virtual Block (VB) is the status of each virtual block for a particular house (e.g., an occupied or unoccupied status for a particular virtual block). PTC Long Block Hazard (PTC LB Haz) represents a PTC message and the specific payload is a device type of hazard, which is a single bit data. Each one of the houses' vital logic controllers can receive these signals. In one embodiment, the vital logic controllers can be aggregated or slaved to another virtual logic controller. In another embodiment, the vital logic controller can transmit the messages to the onboard computer.

Each FIG. 1-9 also includes an indication of the Virtual Block health on the west side 104*a*-104*c* of the houses 103*a*-103*c* and an indication of the Virtual Block health on the east side 105*a*-105*c* of the houses 103*a*-103*c*. The west-side Virtual Block health indication 104*a*-104*c* and the east-side Virtual Block health indication 105*a*-105*c* can have a message, bit, flag, or other suitable mechanism associated therewith to indicate the health of a virtual block from a house's 103 perspective. For illustrative purposes, the health of the virtual blocks are indicated in the attached figures with a "check mark" above a VB with a heart icon for healthy virtual blocks and an "X" above a VB with a heart icon for unhealthy virtual blocks. The system can maintain a high state (e.g., logical '1') for healthy virtual blocks and a low state (e.g., logical '0') for unhealthy virtual blocks.

In one embodiment, the table can also include an indication of the current mode of operation (e.g., virtual block mode (VB) or long block mode (LB)) for the West track circuit (WB) and East track circuit (EB) of each house 103. In one embodiment, the WB can be the physical track circuit on the west-side of a house 103, from the insulated joint 102 proximate the house 103 (e.g., 102*c*) to the corresponding insulated joint 102 of an adjacent house 103 (e.g., 102*b*). In another embodiment, a portion of a table showing the current mode of operation for the WB and EB track circuits for three houses is shown below, with only the EB track circuit for house #3 operating in a VB mode:

| Mode LB | WB – EB | LB Mode | LB | WB – EB | LB Mode | LB | WB – EB | VB Mode |
|---|---|---|---|---|---|---|---|---|

In one embodiment, the low state (unhealthy) can be configured to be the safe state. It is far safer to assume that a block is unhealthy when it may actually be healthy, than to assume the block is healthy when it may be unhealthy, so the system must assume that a block is unhealthy unless shown otherwise. In another embodiment, the safe state can indicate that the block is unhealthy as a failure mode. In traditional signaling terminology the term "stick" can be used to define a variable that is held in a particular state after a pattern is established. Additionally, the variable can "stick" to a predetermined value (e.g., high or low) because of a known condition.

In one embodiment, to prevent issues from occurring for the head-end of the train, instead of running the system at rest in VB mode, LB mode is used by default. In addition to broadcasting the Virtual Block states, the system can also broadcast two additional data bits representing the status of the entire virtual block track (e.g., two physical track miles) as a whole on either side of the house. For example, one bit can represent two miles to the west of a house and the other bit can represent two miles to the right of the house. So, at this moment in time, the physical track circuit status is good because the system receives a code 1 and a code 2 from the far house (e.g., house #3). If the system can receive codes, the Virtual Block is unoccupied, so it can broadcast a '1' to the train for the entire Virtual Block. The system can also broadcast to the train a '1' for the PTC statuses. So, these bits together can define the status of this 2 mile section as a whole.

FIG. 1 illustrates a track section with no trains in the vicinity. All houses 103*a*-103*c* can generate and maintain a Virtual Block (VB) value of '11111111' representing unoccupied blocks in the corresponding virtual track blocks $A_i$-$H_i$ (e.g., i=0, 1, 2, 3, 4, etc.), respectively. When a train enters a virtual block and shunts the circuit, the VB value for that virtual block can change from a logical '1' to a logical '0,' or any suitable value. The Virtual Block is healthy, as shown by the west-side Virtual Block health indication 104*a*-104*c* and the east-side Virtual Block health indication 105*a*-105*c* all having a "check mark" above a VB with a heart icon, which can correspond with a high state (e.g., logical '1') stored and transmitted by the system. Referring to the table at the bottom of FIG. 1, the system is at rest in Long Block Mode (LB).

In FIG. 1 there is no train on the tracks and there is no detection of such from either long block or the virtual block. Accordingly, house #1 103*a*, house #2 103*b*, and house #3 103*c* can generate and maintain a Virtual Block (VB) value of '11111111' via the system (e.g., one or more local or remote VLCs) indicating that none of the Virtual Blocks are occupied from their perspective. In one embodiment, the system can monitor the LB mode status and mask the VB mode status. At this point, the onboard may not know whether the system is operating in LB mode or VB mode (the operational statuses). In another embodiment, both statuses can be conveyed all the time to the train and the wayside responsibility of ensuring one or the other statuses are broadcast appropriately can be undertaken by the system. In another embodiment, a back end (e.g., a virtual logic controller) can make the determination of whether the train receives a LB mode status or a VB mode status. In another embodiment, the train may receive both the LB mode status and the VB mode status but can ensure that whichever mode it is operating in, the system is not masking the statuses. For example, the operational statuses are independent (e.g., not being held as one), and allowed to drop to zero according to whichever mode the system is operating in as defined within the virtual logic controller's logic. In another embodiment, the system can mask one or the other operational statuses at any given time. In another embodiment, while at rest, a track circuit can include a PTC LB HAZ identifying no track circuit shunts. For example, the PTC LB HAZ can list "1------1" for house #1, "1------1" for house #2, and "1------1" for house #3, thereby indicating no shunted (e.g., occupied) Virtual Block track segments on either the WT or ET from the perspective of any house (e.g., houses #1-#3). In another embodiment, the system operates in LB status while at rest (e.g., unoccupied).

Figure 2:
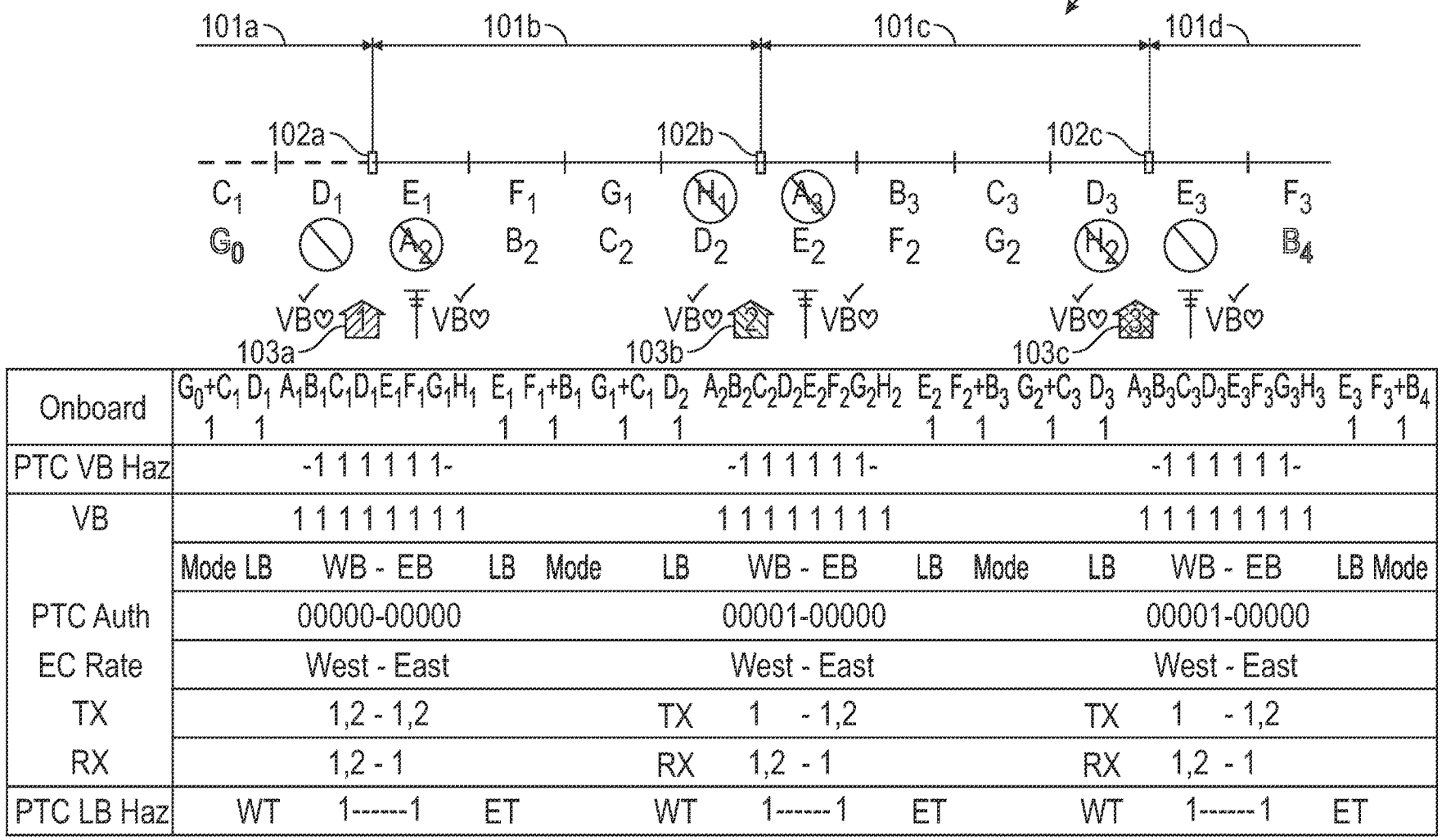
FIG. 2 illustrates a diagram showing the system of FIG. 1, with an authority line to the leftmost signaling house, and corresponding message values, in accordance with one or more exemplary embodiments of the present disclosure.

Referring to FIG. 2, the system 100 can line a movement authority 202 to a first location, such as house #1. In one embodiment, the PTC Auth can be set to indicate passage through one or more houses #1-#3. For example, when a movement authority is granted through house #3 and house #2, up to house #1, the west-bound flags (e.g., 1) can be set for PTC Auth value for house #3 and house #2. As the train will be moving from east to west on the tracks. Since the train only has movement authority up to house #1 (and not past it), the west-bound flag is not set for house #1. The Virtual Block is still healthy, as shown by the west-side Virtual Block health indication 104*a*-104*c* and the east-side Virtual Block health indication 105*a*-105*c* all having a "check mark" above a VB with a heart icon, which can correspond with a high state (e.g., logical '1') stored and transmitted by the system. Referring to the table at the bottom of FIG. 1, the system is still at rest in Long Block Mode (LB).

Figure 3:
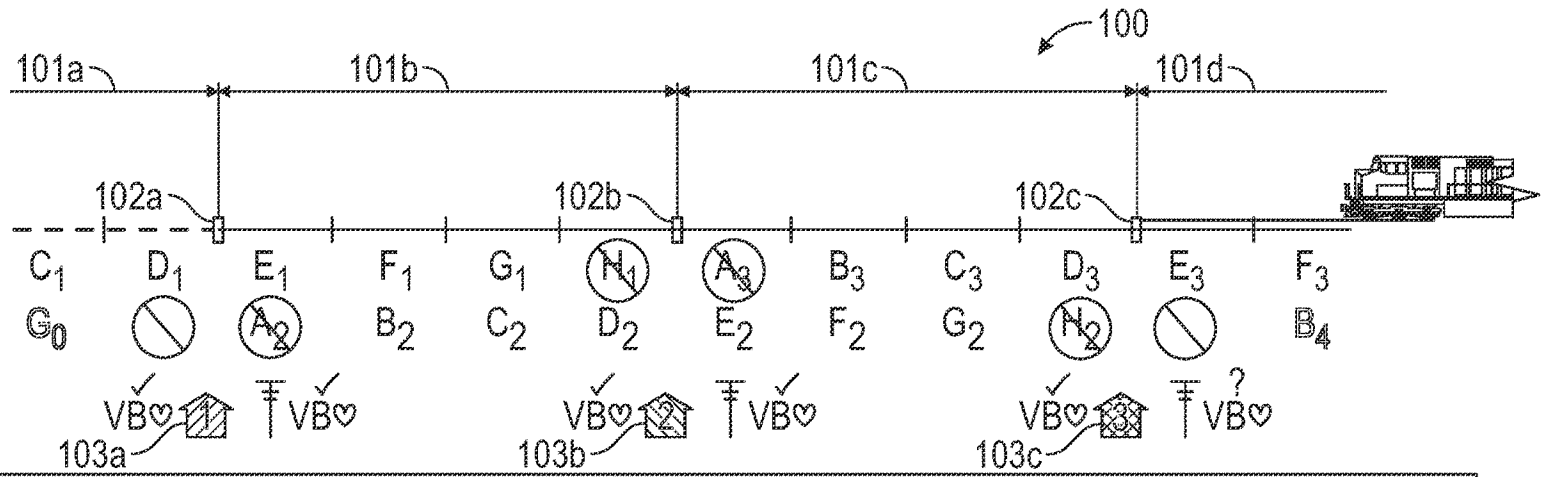
FIG. 3 illustrates a diagram showing the system of FIG. 1, with a westbound train approaching the rightmost signaling house and corresponding message values, in accordance with one or more exemplary embodiments of the present disclosure.

Referring to FIG. 3, as a train 104 enters physical block 101*d* on its way to the first location (e.g., house #1), the train 104 can occupy and shunt a first stage virtual block (e.g., $H_3$ of house #3), setting the $H_3$ VB variable to '0.' House #1 and house #2 can generate and maintain a Virtual Block (VB) value of '11111111' via the system indicating that none of the Virtual Blocks from their perspective are occupied, while house #3 can generate and maintain a Virtual Block (VB) value of '11111110' via the system indicating that one of the Virtual Blocks from its perspective is occupied. In another embodiment, once a Virtual Block shunt is detected, while in LB mode the PTC Auth can be set to indicate the occupancy of the train 104 on the ET from house #3's perspective. For example, the system can set the PTC LB HAZ to '1------0' to indicate a shunt on the ET from the perspective of house #3.

In one embodiment, the system can monitor the LB mode status and mask the VB mode status. In another embodiment, when a virtual block shunt is detected, the system wants to transition the mode of operation from LB mode to VB mode to provide greater granularity of the location of the train. However, although shunted, the system may have not yet verified that the virtual block is healthy to transition the mode of operation to VB, so the mode of operation remains in LB. The PTC VB Haz $H_3$ virtual block variable is in a "don't care" state as it is the furthest from house #3. In another embodiment, the don't care state can be shown in the drawings as a circle with a slash through it superimposed over a particular Virtual Block identifier, or as a "-" in a message or bit representation. Referring to the table at the bottom of FIG. 1, the system is still at rest in Long Block (LB) mode. For LB mode purposes, the train shunts 204 the EB of house #3 and the PTC LB Hazard for the ET track of house #3 can be transitioned from '1' to '0.' For example, the PTC LB HAZ can list "1------1" for house #1, "1------1" for house #2, and "1------0" for house #3, thereby indicating the shunt east of house #3. The Virtual Blocks west of house #3 are still healthy, as shown by the west-side Virtual Block health indication 104*a*-104*c* and the east-side Virtual Block health indication 105*a*-105*b* all having a "check mark" above a VB with a heart icon. However, after detecting the East side shunt at house #3, the system can verify the VB health of the EB virtual blocks indicated by the east-side Virtual Block health indication 105*c* having a "question mark" above the VB with a heart icon. In another embodiment, during a virtual block check, the system can identify a virtual block as unhealthy by default, regardless of actual status.

In one embodiment, the system does not know with certainty whether a virtual block is healthy upon entry of a train 104, as such it can perform an analysis to determine the virtual block health. For example, the resistance of the rails can be affected by conditions such as temperature, age, ballast (gravel underneath their railroad ties), moisture, or other condition that can shift the rail resistance values of the tracks up or down. In another embodiment, the resistance measurement and analysis can determine a confidence level that the virtual block is healthy upon entry of the train. In another embodiment, the health checks can be performed by the near-sided house's perspective, the far-side house's perspective, or a suitable combination or distribution of both. In another embodiment, a malfunction of equipment or presence of an obstacle on the track can trigger the system to indicate a Virtual Block is unhealthy.

There is nothing to be gained by transitioning out of LB mode into VB mode at this moment. It's the following train that gains from VB mode. So, the system can allow the train to move into a Virtual Block while virtual block is unhealthy or the VB health is unknown. In another embodiment, because the system is in LB mode instead of VB mode, the system can drop the entire physical track circuit. In another embodiment, the onboard computer can have the perspective of the same geographic location as the physical track. For example, since the onboard computer knows the geographic footprint represented by a Virtual Block, and it knows that it is currently occupying a geographic footprint at the same time that the Virtual Block was shunted (e.g., went to '0'), therefore the train itself shunted the Virtual Block, and so an obstruction will not be identified. So, in this mode, the train is clear to proceed at full speed. In another embodiment, an obstruction for the train can be when the train itself is not occupying a Virtual Block.

Figure 4:
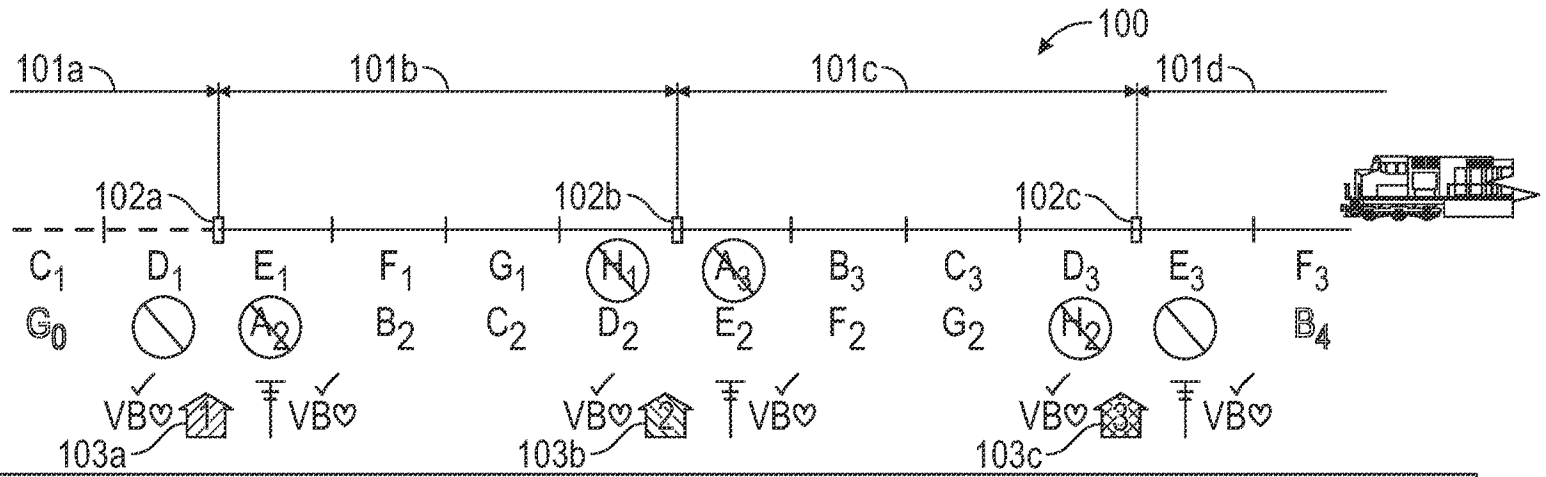
FIG. 4 illustrates a diagram showing the system of FIG. 1, with a westbound train entering a $H_3$ virtual block and corresponding message values, in accordance with one or more exemplary embodiments of the present disclosure.

Referring to FIG. 4, in one embodiment, once the system conducts a virtual block health check and identifies that the Virtual Block health of the EB Virtual Blocks is "healthy," the EB Virtual Blocks indicated by the east-side Virtual Block health indication 105*c* can be changed to a "check mark" above the VB with a heart icon. In another embodiment, after a predetermine period of time (e.g., 10 sec after train entry into a VB), the application can change from the Long Block mode to the Virtual Block mode on the East Track circuit of house #3.

In one embodiment, immediately after a Virtual Block health indication is determined to be healthy and a Virtual Block is shunted, the mode of operation can be set to VB mode and the train proceeds through the virtual block. In another embodiment, if a Virtual Block can be determined to be unhealthy as the train 104 passes through the Virtual Block, the system can then determine that it is safe to move the train through the recently unhealthy VB because it knows that up until this moment that the Virtual Block was unoccupied. In another embodiment, the system can determine continuously or at set intervals of time, whether or not each Virtual Block is healthy. In another embodiment, when the virtual block goes unhealthy, the system can drop all of the health statuses and assume all the Virtual Blocks are unhealthy.

When the train 104 shunts virtual block $H_3$ and that VB is determined to be healthy, the system can identify the following states for each of the virtual blocks for each house:

| | | | | | | | | | | | | |
|---|---|---|---|---|---|---|---|---|---|---|---|---|
| Onboard | $G_0$•$C_1$ $D_1$ $A_1B_1C_1D_1E_1F_1G_1H_1$ | $E_1$ $F_1$•$B_1$ | $G_1$•$C_1$ $D_2$ | $A_2B_2C_2D_2E_2F_2G_2H_2$ $F_3$•$B_4$ | $E_2$ $F_2$•$B_3$ $G_2$•$C_3$ $D_3$ | $A_3B_3C_3D_3E_3F_3G_3H_3$ | $E_3$ |
| | 1 1 1 1 1 1 1 1 1 1 1 1 | | | | | | |
| pTC VB Haz | -111111- | | | | -111111- | -111111- | |
| VB | | 11111111 | | | 11111111 | 11111110 | |
| | Mode LB | WB – EB | LB | Mode | LB | WB – EB LB Mode LB | WB – EB VB Mode |
| PTC Auth | | 00000-00000 | | | | 00001-00000 | 00001-00000 |
| EC Rate | | West-East | | | | West-East | West-East |
| TX | | 1.2-1.2 | | | TX | 1-1.2 | IX 1-1 |
| RX | | 1.2-1 | | | RX | 1.2-1 | RX 1.2-NC |
| PTC LB Haz | WT | 1------1 | ET | | WT | 1------1 ET | WT 1------1 ET |

In particular, the mode of operation for the EB track of house #3 is set to VB mode and the PTC LB Hazard can be transitioned from '0' back to '1.' For example, the system can set the PTC LB HAZ to '1------1' to clear the shunt on the ET from the perspective of house #3. This is one example of the system masking status based upon the operating mode. Once the VB health check is complete and this location is upgraded to the VB mode, the system can recover this track circuit by sticking the VB status high. In another embodiment, the health check may only occur upon the initial shunting of a virtual block. If the system does not make the decision as to whether VB mode is healthy or not upon entry of the train, the system may not get to upgrade again until the train is completely out of the virtual block. So, for example, the system may need to upgrade the VB mode upon entry of the train, if possible, so that the system can take advantage of the upgrade when clearing the virtual block.

The ultimate decision on when to change from LB mode to VB mode can be made by the control logic, based on analysis of the conditions of the various Virtual Block or operational statuses. The system can receive a confidence indication of the virtual block status. Even if the system has confidence in their Virtual Block statuses, the system can choose to operate in LB mode anyway, because the system can identify that both are unoccupied, but the logic itself can be in long block mode at this moment, and at this moment even though the virtual block health condition of the chassis is still under evaluation. The system can always operate in VB mode unless it failed. LB mode is the safest mode because it going to protect the entire track circuit no matter what, but if virtual block is healthy and good, the system would benefit from the more granular information while maintaining safety.

Figure 5:
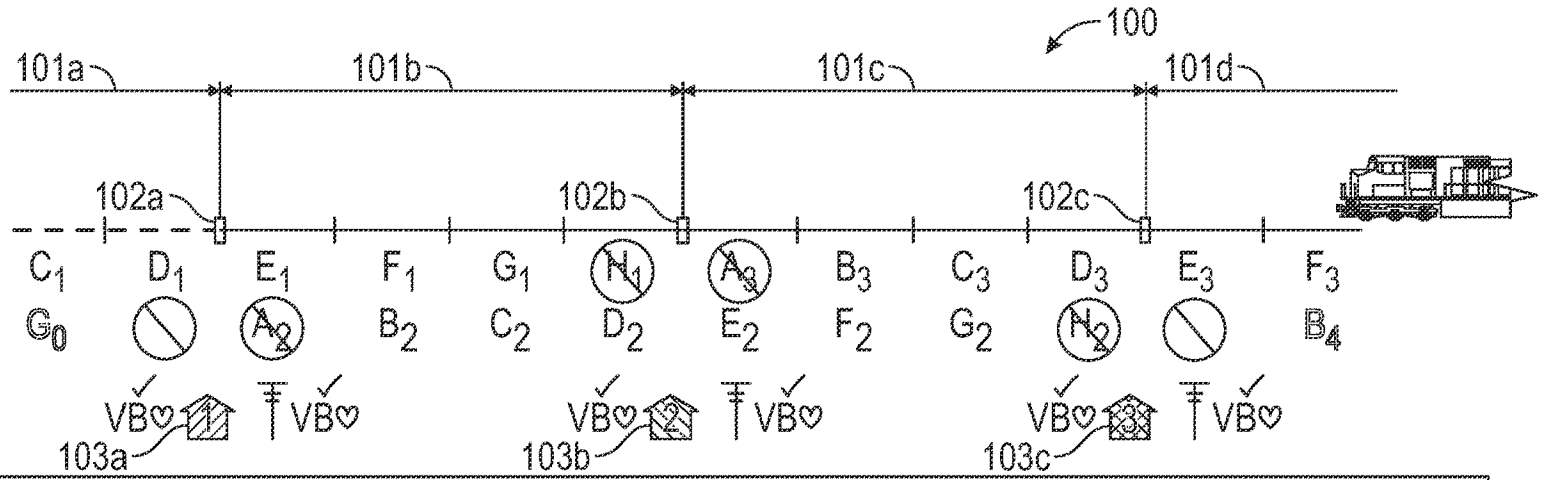
FIG. 5 illustrates a diagram showing the system of FIG. 1, with a westbound train entering a $G_3$ virtual block and corresponding message values, in accordance with one or more exemplary embodiments of the present disclosure.

Referring to FIG. 5, as the train 104 continues westbound, the train then occupies a section of the track and shunts $G_3$ virtual block. House #1 and house #2 can generate and maintain a Virtual Block (VB) value of '11111111' via the system indicating that none of the Virtual Blocks from their perspective are occupied, while house #3 can generate and maintain a Virtual Block (VB) value of '11111100' via the system indicating that two of the Virtual Blocks from its perspective are occupied. The system can broadcast the shunt at VB $G_3$ to the train. Although the Virtual Block $H_3$ is no longer visible, the system can determine that there is a shunt at virtual block $G_3$. The PTC VB HAZ can list "-111110-" indicating that the $G_3$ virtual block of house #3 is shunted. Virtual Block $H_3$ from house #3 can be identified as being in a "don't care" status, as a more EB house would have a better understanding of that Virtual Block's status.

Figure 6:
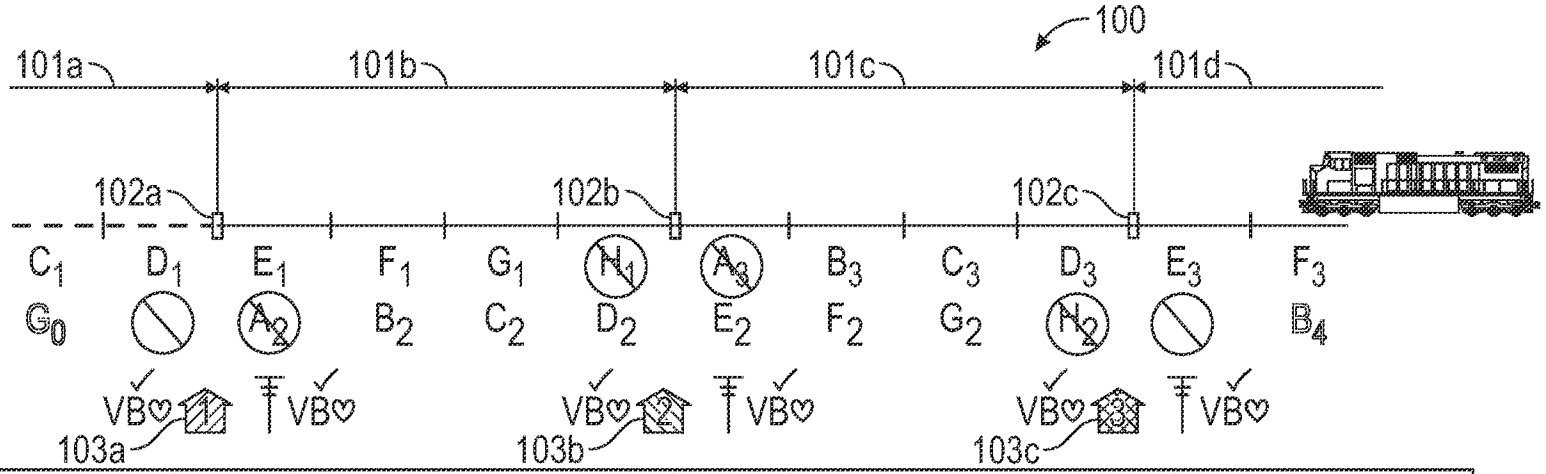
FIG. 6 illustrates a diagram showing the system of FIG. 1, with a westbound train entering an $F_3$ virtual block and corresponding message values, in accordance with one or more exemplary embodiments of the present disclosure.

Referring to FIG. 6, as the train 104 continues westbound, the train then occupies a section of the track 204 and shunts the $F_3B_4$ virtual block. House #1 and house #2 can generate and maintain a Virtual Block (VB) value of '11111111' via the system indicating that none of the Virtual Blocks from their perspective are occupied, while house #3 can generate and maintain a Virtual Block (VB) value of '11111000' via the system indicating that three of the Virtual Blocks from its perspective are occupied. In one embodiment, $G_3$ virtual block is no longer visible from house #3's perspective, so the PTC hazard can be stuck up. The PTC VB HAZ can list "-111101-" indicating that the Virtual Block $F_3$ of house #3 is shunted. Virtual Block $G_3$ from house #3 can be identified as being unoccupied (e.g., '1'), and Virtual Block $H_3$ from house #3 in a "don't care" status, as a more EB house would have a better understanding of that Virtual Block's status.

Figure 7:
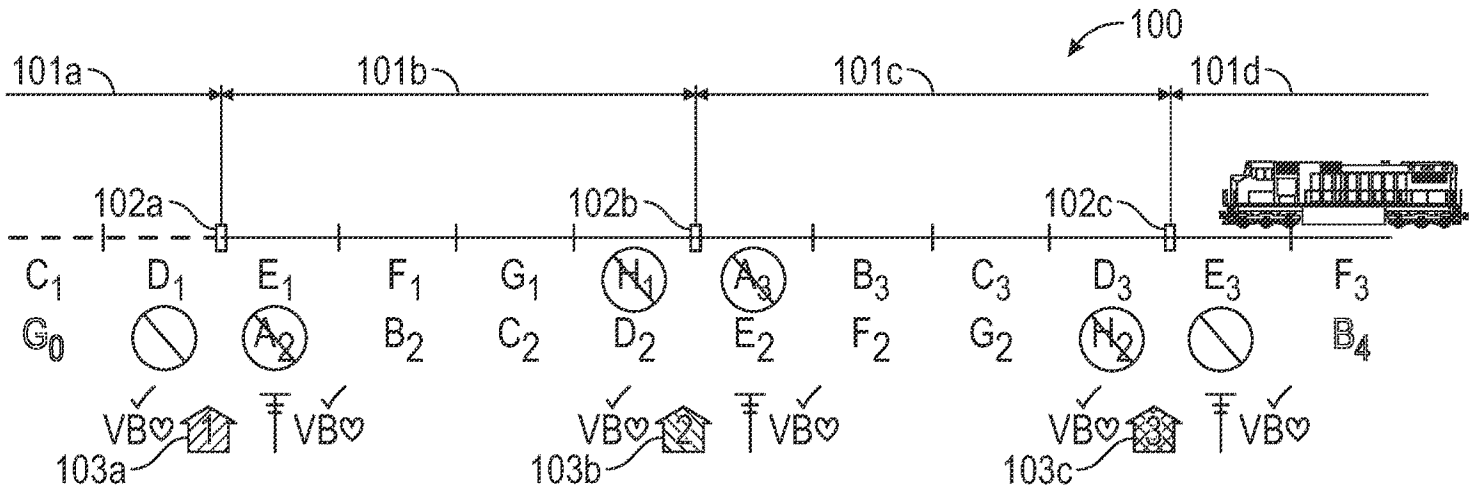
FIG. 7 illustrates a diagram showing the system of FIG. 1, with a westbound train entering an $E_3$ virtual block and corresponding message values, in accordance with one or more exemplary embodiments of the present disclosure.

Referring to FIG. 7, as the train 104 continues westbound, the train then occupies a section of the track 204 and shunts the $E_3$•$A_4$ virtual block. House #1 and house #2 can generate and maintain a Virtual Block (VB) value of '11111111' via the system indicating that none of the Virtual Blocks from their perspective are occupied, while house #3 can generate and maintain a Virtual Block (VB) value of '11110000' via the system indicating that two of the Virtual Blocks from its perspective are occupied. In one embodiment, Virtual Blocks $F_3$ and $G_3$ are no longer visible from house #3's perspective, so the PTC hazard for $F_3$ and $G_3$ can be stuck up. The PTC VB HAZ can list "-111011-" indicating that the Virtual Block $E_3$ of house #3 is shunted. Virtual Blocks $F_3$ and $G_3$ from house #3 can be identified as being unoccupied (e.g., '1'), and Virtual Block $H_3$ from house #3 in a "don't care" status, as a more EB house would have a better understanding of that Virtual Block's status.

Figure 8:
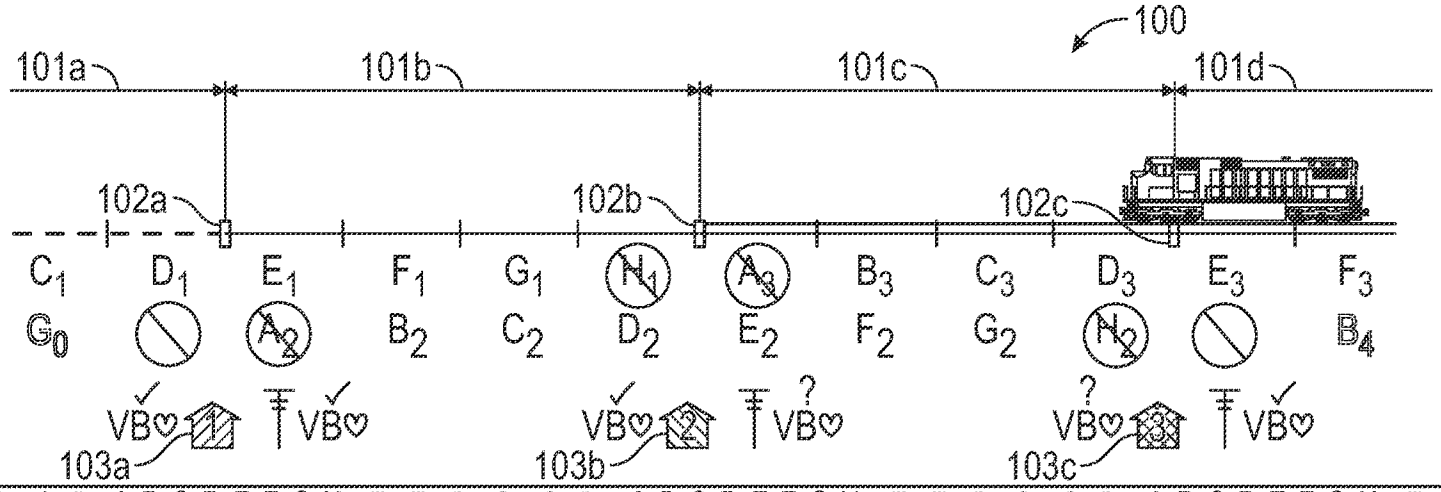
FIG. 8 illustrates a diagram showing the system of FIG. 1, with a westbound train entering a $D_3$ virtual block, with a known and an unknown virtual block health status and corresponding message values, in accordance with one or more exemplary embodiments of the present disclosure.

Referring to FIG. 8, as the train 104 continues westbound, the train passes house #3 and occupies a section of the track 204 while shunting the $H_2$•$D_3$ Virtual Block. House #1 can generate and maintain a Virtual Block (VB) value of '11111111' via the system indicating that none of the Virtual Blocks from its perspective are occupied, while house #2 can generate and maintain a Virtual Block (VB) value of '11111110' via the system indicating that one of the Virtual Blocks from its perspective are occupied, and house #3 can generate and maintain a Virtual Block (VB) value of '00000000' via the system indicating that all of the Virtual Blocks from its perspective are occupied. In one embodiment, the system can be in LB Mode at rest when the train shunts a section of the track circuit 802 between houses #2 and #3. In another embodiment, since the system is in LB mode for the WB track of house #3, all Virtual Blocks in the WB track can be shown as shunted (e.g., '00000000'). In another embodiment, once a Virtual Block shunt is detected, while in LB mode the PTC Auth can be set to indicate the occupancy of the train 104 on the ET from house #2's perspective. For example, the system can set the PTC LB HAZ to '1------0' to indicate a shunt on the ET from the perspective of house #2. In another embodiment, since the track circuit 802 between houses #2 and #3 are shunted, the VB health status for track circuit 802 is identified as unknown ('?' 105*b* and '?' 104*c*) and again queried by the system. The system can then perform a Virtual Block health check to determine whether the track circuit Virtual Blocks are healthy and upgrade the operational status from LB mode to VB mode. In another embodiment, PTC hazard for $F_3$ and $G_3$ can be stuck up. The PTC VB HAZ can list "-110011-" indicating that the Virtual Block $E_3$ of house #3 is shunted. Virtual Blocks $F_3$ and $G_3$ from house #3 can be identified as being unoccupied (e.g., '1'), and Virtual Block $H_3$ from house #3 in a "don't care" status, as a more EB house would have a better understanding of that Virtual Block's status. In another embodiment, as the train progressive through the block, a shunt is detected, the entire physical track circuit can be dropped from both houses perspectives because both ends of a particular block are operating in LB mode and the system performs the health status check. In another embodiment, because the entire track 802 is down, the train 104 is still safe to proceed forward.

In one embodiment, for LB mode purposes, since a new track circuit 802 between houses #2 and #3 is shunted, the PTC LB Hazard for the ET track of house #2 and the WT track of house #2 can be transitioned from '1' to '0.' For example, the PTC LB HAZ can list "1------1" for house #1, "1------0" for house #2, and "0------1" for house #3, thereby indicating the shunt between houses #2 and #3. The Virtual Blocks west of house #2 and east of house #3 are still healthy, as shown by the west-side Virtual Block health indications 104*a*, 104*b* and the east-side Virtual Block health indications 105*a*, 105*c* all having a "check mark" above a VB with a heart icon. However, after detecting the shunt between houses #2 and #3, the system can verify the VB health of the EB virtual blocks indicated by the east-side Virtual Block health indication 105*b* and west-side Virtual Block health indication 104*c* having a "question mark" above the VB with a heart icon. Accordingly, the system can query and indicate a Virtual Block health indication for any number of houses, track circuits, or Virtual Blocks.

Figure 9:
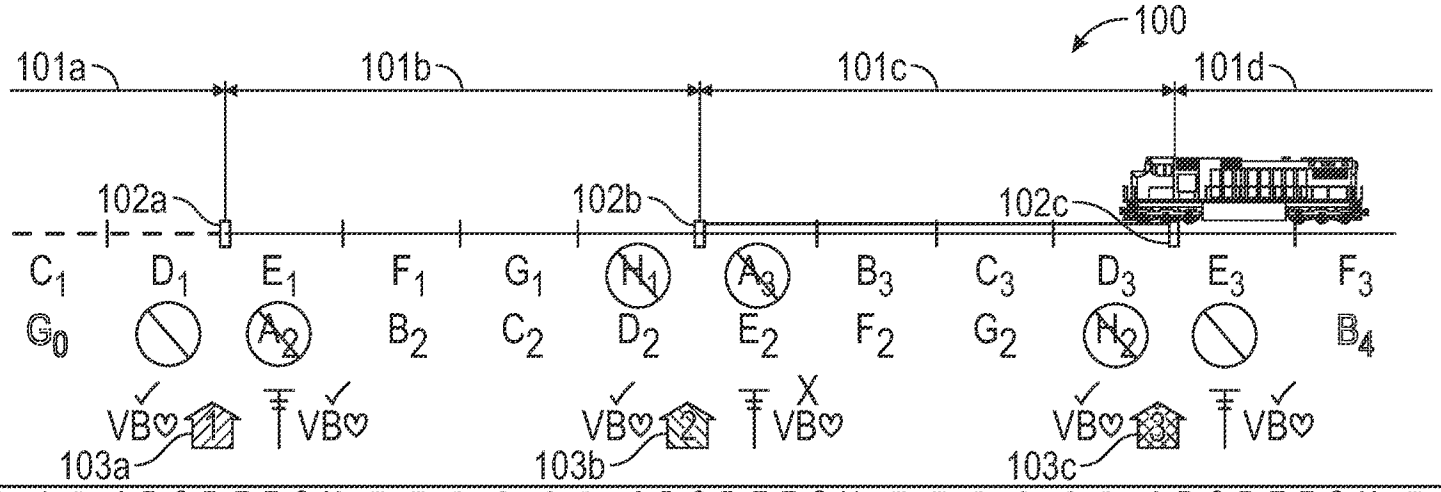
FIG. 9 illustrates a diagram showing the system of FIG. 1, with a westbound train entering a $D_3$ virtual block, with known virtual block health statuses and corresponding message values, in accordance with one or more exemplary embodiments of the present disclosure.

Referring to FIG. 9, as the train continues west-bound, the train occupies a section of the track 204 and shunts the $H_2$•$D_3$ virtual block. House #1 can generate and maintain a Virtual Block (VB) value of '11111111' via the system indicating that none of the Virtual Blocks from its perspective are occupied, while house #2 can generate and maintain a Virtual Block (VB) value of '11110000' via the system indicating that the EB Virtual Blocks from its perspective are occupied, and house #3 can generate and maintain a Virtual Block (VB) value of '00000000' via the system indicating that all of the Virtual Blocks from its perspective are occupied. In one embodiment, all Virtual Blocks are still healthy, as shown by the Virtual Block health indications 104*a*-104*c*, 105*a*, and 105*c* all having a "check mark" above a VB with a heart icon. However, if the VB health of any of the Virtual Blocks for a particular house fail, the respective Virtual Block health indication can indicate the failure with a graphic, icon, or notification. For example, the Virtual Block health indications 105*b* can be an "exclamation mark," an "X," or other suitable icon or graphic.

In one embodiment, since the system is in LB mode for the EB track of house #2, all Virtual Blocks in the WB track can be shown as shunted (e.g., '11110000'). In particular, the mode of operation for the WB track of house #3 is set to VB mode and the PTC LB Hazard can be transitioned from '0' back to '1.' For example, the system can set the PTC LB HAZ to '1------1' to clear the shunt on the WT from the perspective of house #3. This can be yet another example of the system masking status based upon the operating mode. In one embodiment, upon completion of the health status check, the system can determine that a Virtual Block from house #2's perspective is unhealthy. In another embodiment, the system can drop the unhealthy states and can optionally remain in LB mode on house #2. In another embodiment, even if house #3 is in VB mode and the system leaves that the track circuit down, the train 104 can still progress through this block even though these Virtual Blocks are identified as unhealthy. For example, that virtual block health condition failure mode can be masked as irrelevant to the train 104 move at the head-end of the train 104. It may however be relevant at the tail-end of the train 104. In another embodiment, the tail-end of the train 104 can hold the entire physical block down for a following second train. This may simply result in a slowing of the second train for a particular distance or duration (e.g., a mile and a half or so). However, advantageously, the system provides for the continual movement of trains, albeit operating in LB mode instead of VB mode when a virtual block is not a healthy state.

In one embodiment, because the system can be in VB mode from the perspective of house #3, the system can stick the PTC LB HAZ WT 'high' for house #3 (e.g., '1------1') and rely on these statuses. For example, that safe state being indicated as occupied (e.g., a '0') can be the safest to assume for the virtual blocking. But if the state is identified as unoccupied (e.g., a '1') in LB mode, then the system can automatically check the health status because the system did not transition a track circuit to VB mode even though it is occupied. In another embodiment, the system can mask one or the other statuses at any given time, based on this condition. The system can determine operating status as a granularity issue, but also as a prioritization issue where the system can identify that the train 104 is not in a particular virtual block and we have a negative health indicator for one of the virtual blocks, so the system can override the operating mode. For example, the system can operate in LB mode until the concern is addressed. In another embodiment, the LB mode can help prioritize which of the two statuses need to be unmask from a safety perspective.

In one embodiment, because the train 104 is occupying a Virtual Block, even if the Virtual Block is down because of health issues, there is no issue because the train 104 occupies the Virtual Block so if the system doesn't have to stick the occupancy status high, it is not going to. In another embodiment, the onboard computer may not differentiate between an LB mode and a VB mode. For example, the onboard computer may be primarily concerned with determining if the train 104 has potential obstructions in its way and whether those obstructions are safe or unsafe. In another embodiment, the system can choose, at the wayside, to artificially hold certain virtual blocks safe or unsafe by ensuring that in our logic, at any given time, there is at least one condition that is not masked that provides for the accurate and safe operation of the train.

Figure 10:
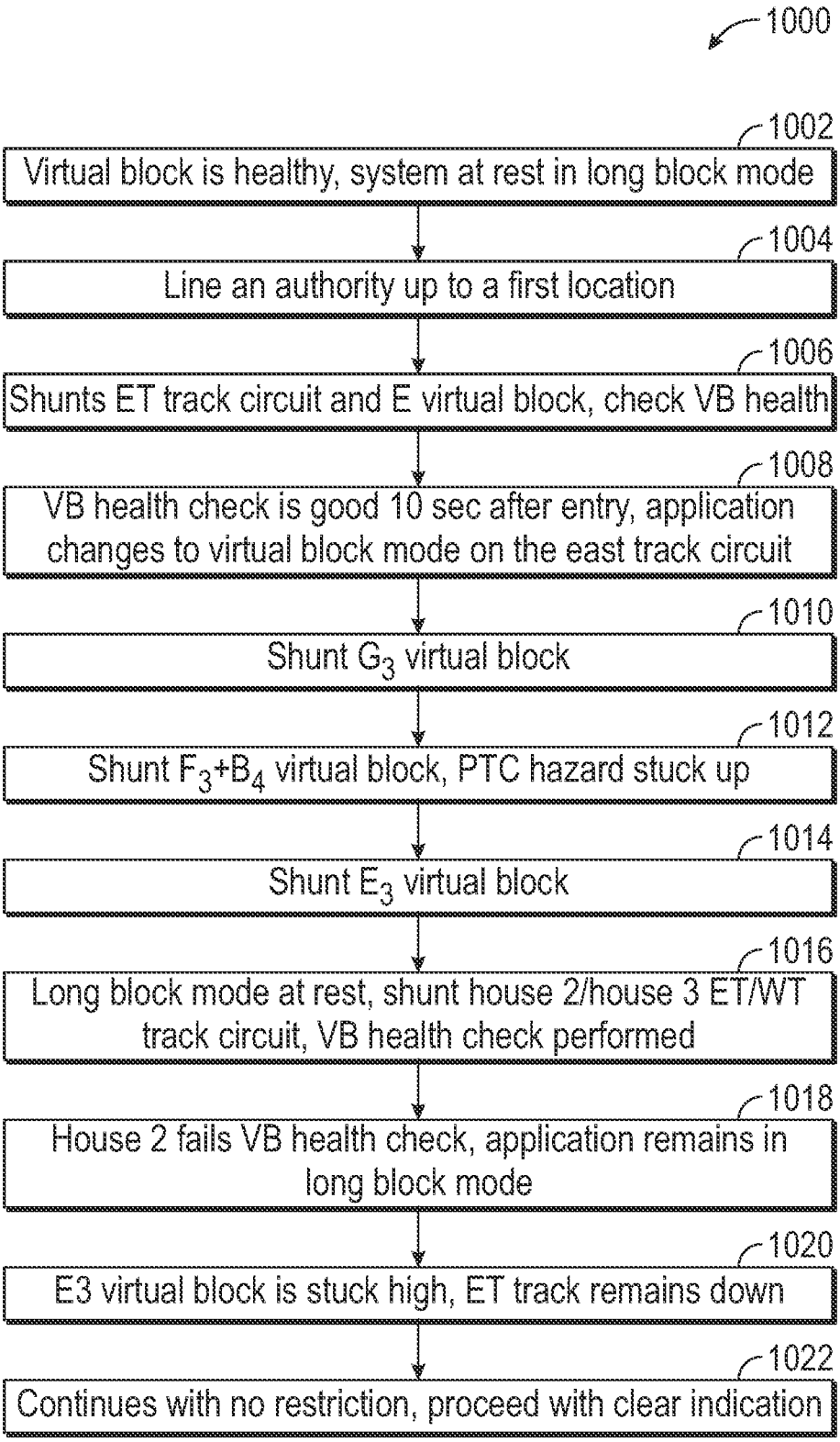
FIG. 10 illustrates a flowchart diagram exemplifying control logic embodying features of a method of virtual block operational status control with long block logic, in accordance with one or more exemplary embodiments of the present disclosure.

FIG. 10 illustrates a flowchart diagram exemplifying control logic 1000 embodying features of a method of virtual block operational status control with long block logic, in accordance with an exemplary embodiment of the present disclosure. The VB operational status control logic 1000 can be implemented as an algorithm on a computer processor (e.g., vital logic controller, onboard computer, server), a machine learning module, or other suitable system or combination thereof. Additionally, the VB operational status control logic 1000 can be achieved with software, hardware, an application programming interface (API), a network connection, a network transfer protocol, HTML, DHTML, JavaScript, JSON, Ruby, Rails, other suitable applications, or a suitable combination thereof. The VB operational status control logic 1000 (e.g., computer processor) can be capable of executing machine-readable instructions to perform program steps and operably coupled to a memory having a first database with a plurality of messages, signal values, and specifications related to a vehicle and at least a portion of a railroad track. The messages can include Onboard PTC LB Haz, PTC VB Haz, VB, PTC Auth, EC Rate, TX, RX, PTC LB Haz, or other suitable messages. The messages can have fields and data associated thereto.

The VB operational status control logic 1000 can leverage the ability of a computer platform to spawn multiple processes and threads by processing data simultaneously. The speed and efficiency of the VB operational status control logic 1000 can be greatly improved by instantiating more than one process to facilitate virtual block operational status control. However, one skilled in the art of programming will appreciate that use of a single processing thread may also be utilized and is within the scope of the present disclosure. VB operational status control logic 1000 can also be distributed amongst a plurality of networked computer processors. The computer processors can be located in the wayside houses 103 or onboard the train 104.

The VB operational status control logic 1000 process flow of the present embodiment begins at step 1002, wherein the control logic 1000 can determine that a virtual block is healthy and the system is at rest in long block mode. In one embodiment, the control logic 300 can be configured to receive data from sensors or other data-gatherers on and/or by a railroad track and instantiating the control logic 1000 at step 1002 can prepare the control logic 1000 to receive, process, and store the data. The control logic 1000 then proceeds to step 1004.

At step 1004, the control logic 1000 can line an authority up to a first location. For example, the control logic 1000 can send a PTC Auth message to the relevant wayside houses to ensure authority to move along the track. In another embodiment, the control logic 1000 can indicate a direction of travel. The control logic 1000 then proceeds to step 1006.

At step 1006, the control logic 1500 can detect a shunt in a track circuit, assign a shunt value to a first virtual block (e.g., VB $H_3$ (not shown)), and conduct a virtual block health check. In one embodiment, the control logic 1000 can determine a shunt based upon an electrical signal sent along the rails. In another embodiment, the shunt can be determined based upon the measured impedance, or time of receipt of a signal. In another embodiment, the control logic can identify the location of the shunt in the first virtual block based upon one or more measurements taken by a wayside house, for example, house #3 103*c*. The control logic 1000 can assign a status value low (e.g., 0) to indicate that the virtual block is shunted, and therefore occupied by a train or hazard. For example, the bit value of the relevant bit of a PTC VB Haz, PTC LB Haz, or VB message can be assigned by the control logic 1000. In another embodiment, a shunt can be detected when a train occupies a monitored virtual block and an electrical signal transmitted on one rail travels along the axel of the train and returns on a second rail. In another embodiment, the control logic 1000 can determine the status of the virtual blocks it monitors from a particular wayside house's perspective. The control logic 1000 can also initiate the reacquisition or calibration of one or more virtual block statuses. The control logic 1000 then proceeds to step 1008.

At step 1008, the control logic 1000 can determine that the VB health check is good, and after a predetermined period (e.g., 10 sec after train entry), the control logic 1000 can change to a VB mode of operation. The control logic 1000 then proceeds to step 1010.

At step 1010, the control logic 1500 can assign a shunt value to a second virtual block (e.g., VB $G_3$) of a first wayside house. In one embodiment, the control logic 1500 can determine a shunt based upon an electrical signal sent along the rails. In another embodiment, the shunt can be determined based upon the measured impedance, or time of receipt of a signal. In another embodiment, the control logic can identify the location of the shunt in the third virtual block based upon one or more measurements taken by a wayside house, for example, house #3 103*c*. The control logic 1000 can assign a status value low (e.g., 0) to indicate that the virtual block is shunted, and therefore occupied by a train or hazard. For example, the bit value of the relevant bit of a PTC VB Haz, PTC LB Haz, or VB message can be assigned by the control logic 1000. The control logic 1000 can assign a value for a status bit associated with a particular virtual block. For example, the control logic 1000 can stick a PTC VB Haz value high (e.g., 1) by assigning a logic '1' value to the bit for the associated virtual block. In one embodiment, the shunt value can be assigned by the control logic 1000 when or after a train enters a particular virtual block. The control logic 1000 then proceeds to step 1012.

At step 1012, the control logic 1000 can determine that a train has shunted a third virtual block (e.g., VB $F_3$). However, because the second virtual block (e.g., VB $G_3$) is not visible from the perspective of the first wayside house, the PTC VB hazard bit value the second virtual block can be stuck up. From the perspective of house #3 103*c*, because the train is headed westbound and the fourth virtual block shunts any signals transmitted westbound, house #3 103*c* cannot see past the shunt in the second virtual block. In another embodiment, the bit value of the relevant bit of a PTC VB Haz, PTC LB Haz, or VB message can be assigned by the control logic 1000. The control logic 1000 can "stick" a bit value for a particular virtual block to a specific value despite its measured value. In one embodiment, the control logic 1000 can assign a value to a status bit associated with a particular virtual block. The control logic 1000 can stick a PTC VB Haz message bit value high (e.g., 1) by assigning a logic '1' value to the bit for the associated virtual block. For example, the control logic 100 can identify the PTC VB HAZ message as '-111101-', sticking the PTC VB hazard bit value of the second virtual block high (up), even though it may be occupied by a train. The control logic 1000 then proceeds to step 1014.

At step 1014, the control logic 1000 can assign a shunt value to a fourth virtual block (e.g., VB $E_3$). In one embodiment, the control logic 1000 can determine a shunt based upon an electrical signal sent along the rails. In another embodiment, the shunt can be determined based upon the measured impedance, or time of receipt of a signal. In another embodiment, the control logic can identify the location of any shunt based upon one or more measurements taken from the perspective of a wayside house, for example, house #3 103*c*. The control logic 1000 can assign a status value low (e.g., 0) to indicate that the virtual block is shunted, and therefore occupied by a train or hazard. For example, the bit value of the relevant bit of a PTC VB Haz, PTC LB Haz, or VB message can be assigned by the control logic 1000. From the perspective of house #3 103*c*, because the train is headed westbound and the fourth virtual block shunts any signals transmitted eastbound, house #3 103*c* cannot see past the shunt in the third virtual block. The control logic 1000 can also "stick" a bit value for a particular virtual block to a specific value despite its measured value. In one embodiment, the control logic 1000 can assign a value to a status bit associated with a particular virtual block. For example, the control logic 1000 can stick a PTC VB Haz message bit value high (e.g., 1) by assigning a logic '1' value to the bit for the associated virtual block. The control logic 1000 then proceeds to step 1016.

At step 1016, the control logic 1000 can determine that the track circuit is in LB mode at rest, the track circuit between the first wayside house and a second wayside house is shunted, and perform a second VB health check. In one embodiment, as the train 104 continues west-bound, the train passes house #3 and occupies a section of the track 204 while shunting the $H_2$•$D_3$ Virtual Block. In one embodiment, house #1 can generate and maintain a Virtual Block (VB) value of '11111111' via the control logic 1000 indicating that none of the Virtual Blocks from its perspective are occupied, while house #2 can generate and maintain a Virtual Block (VB) value of '11111110' via the control logic 1000 indicating that one of the Virtual Blocks from its perspective are occupied, and house #3 can generate and maintain a Virtual Block (VB) value of '00000000' via the control logic 1000 indicating that all of the Virtual Blocks from its perspective are occupied. In one embodiment, the track circuit can be in LB Mode at rest when the train shunts a section of the track circuit 802 between houses #2 and #3. In another embodiment, once a Virtual Block shunt is detected, while in LB mode the PTC Auth can be set to indicate the occupancy of the train 104 on the ET from house #2's perspective. For example, the control logic 1000 can set the PTC LB HAZ to '1------0' to indicate a shunt on the ET from the perspective of house #2. In another embodiment, since the track circuit 802 between houses #2 and #3 are shunted, the VB health status for track circuit 802 is identified as unknown ('?' 105*b* and '?' 104*c*) and again queried by the control logic 1000. The control logic 1000 can then perform a Virtual Block health check to determine whether the track circuit Virtual Blocks are healthy and upgrade the operational status from LB mode to VB mode. In another embodiment, PTC hazard for $F_3$ and $G_3$ can be stuck up by the control logic 1000. The PTC VB HAZ can be "-110011-" indicating that the Virtual Block $E_3$ of house #3 is shunted. Virtual Blocks $F_3$ and $G_3$ from house #3 can be identified as being unoccupied (e.g., '1'), and Virtual Block $H_3$ from house #3 in a "don't care" status, as a more EB house would have a better understanding of that Virtual Block's status. In another embodiment, as the train progressive through the block, a shunt is detected, the entire physical track circuit can be dropped from both houses perspectives because both ends of a particular block are operating in LB mode and the control logic 1000 can perform the health status check. In another embodiment, because the entire track 802 is down, the train 104 is still safe to proceed forward. The control logic 1000 then proceeds to step 1018.

At step 1018, the control logic 1500 can determine that the second wayside house fails a VB health check and leave the operational status in LB mode. In one embodiment, almost all Virtual Blocks are still healthy, as shown by the Virtual Block health indications 104*a*-104*c*, 105*a*, and 105*c* all having a "check mark" above a VB with a heart icon. However, if the VB health of any of the Virtual Blocks for a particular house fail, the respective Virtual Block health indication can indicate the failure with a graphic, icon, or notification. For example, the Virtual Block health failure indications for a direction of track (e.g., 105*b*) can show an "exclamation mark," "X," or other suitable icon or graphic. The control logic 1000 then proceeds to step 1020.

At step 1020, the control logic 1000 can determine that the second wayside house fails a VB health check. The control logic 1000 can also maintain a LB Mode operational status, stick the EB virtual blocks high from the perspective of the second wayside house, and maintain the ET in a down state from the perspective of the second wayside house. The control logic 1000 then proceeds to step 1022.

At step 1022, the control logic 1000 can indicate that the onboard continue with no restriction and proceed with a clear indication. The control logic 1000 can then terminate or repeat the aforementioned steps as the train receives a second movement authority to the second location.

The present disclosure achieves at least the following advantages:

1. increasing the capacity and safety of the existing railroad track infrastructure used by the railroads by determining whether a virtual block is healthy or unhealthy;
2. a long block mode can provide a coarse granularity on the presence of a train, while a virtual block mode can implement a finer granularity so the virtual aspects of the sub blocks can be realized;
3. providing a long block mode that can provide the system an opportunity to analyze the potential tradeoffs between granularity and reliability by determining which mode (virtual block or long block) is best utilized in a given situation; and
4. operating by default in long block mode and ignore the virtual block capabilities until absolutely needed.

Persons skilled in the art will readily understand that advantages and objectives described above would not be possible without the particular combination of computer hardware and other structural components and mechanisms assembled in this inventive system and described herein. Additionally, the algorithms, methods, and processes disclosed herein improve and transform any general-purpose computer or processor disclosed in this specification and drawings into a special purpose computer programmed to perform the disclosed algorithms, methods, and processes to achieve the aforementioned functionality, advantages, and objectives. It will be further understood that a variety of programming tools, known to persons skilled in the art, are available for generating and implementing the features and operations described in the foregoing. Moreover, the particular choice of programming tool(s) may be governed by the specific objectives and constraints placed on the implementation selected for realizing the concepts set forth herein and in the appended claims.

The description in this patent document should not be read as implying that any particular element, step, or function can be an essential or critical element that must be included in the claim scope. Also, none of the claims can be intended to invoke 35 U.S.C. § 112(f) with respect to any of the appended claims or claim elements unless the exact words "means for" or "step for" are explicitly used in the particular claim, followed by a participle phrase identifying a function. Use of terms such as (but not limited to) "mechanism," "module," "device," "unit," "component," "element," "member," "apparatus," "machine," "system," "processor," "processing device," or "controller" within a claim can be understood and intended to refer to structures known to those skilled in the relevant art, as further modified or enhanced by the features of the claims themselves, and can be not intended to invoke 35 U.S.C. § 112(f). For example, the terms "processor" and "controller" can be a class of structures, rather than one specific structure, and may be defined with functional terms, but that does not make it means-plus-function. Even under the broadest reasonable interpretation, in light of this paragraph of this specification, the claims are not intended to invoke 35 U.S.C. § 112(f) absent the specific language described above.

The disclosure may be embodied in other specific forms without departing from the spirit or essential characteristics thereof. For example, each of the new structures described herein, may be modified to suit particular local variations or requirements while retaining their basic configurations or structural relationships with each other or while performing the same or similar functions described herein. The present embodiments are therefore to be considered in all respects as illustrative and not restrictive. Accordingly, the scope of the disclosure can be established by the appended claims rather than by the foregoing description. All changes which come within the meaning and range of equivalency of the claims are therefore intended to be embraced therein. Further, the individual elements of the claims are not well-understood, routine, or conventional. Instead, the claims are directed to the unconventional inventive concept described in the specification.

What is claimed is:

1. A system for virtual block operational status control, comprising:

a memory having a first database with operational statuses or specifications related to a vehicle or at least a portion of a railroad track; and a processor operably coupled to the memory and capable of executing machine-readable instructions to perform program steps, the program steps including:

generate a plurality of virtual blocks within a physical block;

generate a long block within the physical block;

operate in a long block mode until a virtual block occupancy is detected;

determine whether a first group of virtual blocks from the perspective of a first wayside house are healthy;

operate in a virtual block mode, identifying the occupancy of each of the healthy virtual blocks from the first wayside house perspective, when the first group of virtual blocks are healthy; and operate in the long block mode, identifying the occupancy of the long block from the first wayside house perspective, when the first group of virtual blocks are unhealthy.

2. The system of claim 1, wherein the first group of virtual blocks are from the eastbound perspective of the first wayside house.

3. The system of claim 1, the program steps further comprising:

determine whether a second group of virtual blocks from the perspective of the first wayside house are healthy.

4. The system of claim 3, wherein the second group of virtual blocks are from the westbound perspective of the first wayside house.

5. The system of claim 1, the program steps further comprising:

generate a virtual block health status indication.

6. The system of claim 1, the program steps further comprising:

perform checks over a first time period after the occupancy of a virtual block is detected to determine whether it is safe to maintain virtual block mode.

7. The system of claim 6, wherein the first time period is a 10-second interval.

8. The system of claim 6, wherein the operation in a virtual block mode can fail into a long block mode when a virtual block becomes unhealthy or its health is undetermined.

9. The system of claim 1, wherein the health of a virtual block is represented by a single bit.

10. The system of claim 1, wherein the physical block is a section of track between insulated joints.

11. A method of virtual block operational status control, comprising:

generating, via control logic, a plurality of virtual blocks within a physical block;

generating, via the control logic, a long block within the physical block;

operating in a long block mode until a virtual block occupancy is detected;

determining, via control logic, whether a first group of virtual blocks from the perspective of a first wayside house are healthy;

operating in a virtual block mode, identifying the occupancy of each of the healthy virtual blocks from the first wayside house perspective, when the first group of virtual blocks are healthy; and operating in the long block mode, identifying the occupancy of the long block from the first wayside house perspective, when the first group of virtual blocks are unhealthy.

12. The method of claim 11, wherein the first group of virtual blocks are from the eastbound perspective of the first wayside house.

13. The method of claim 11, further comprising:

determining whether a second group of virtual blocks from the perspective of the first wayside house are healthy.

14. The method of claim 13, wherein the second group of virtual blocks are from the westbound perspective of the first wayside house.

15. The method of claim 11, further comprising:

generating a virtual block health status indication.

16. The method of claim 11, further comprising:

performing checks, via the control logic, over a first time period after the occupancy of a virtual block is detected to determine whether it is safe to maintain virtual block mode.

17. The method of claim 16, wherein the first time period is a 10-second interval.

18. The method of claim 16, wherein the operation in a virtual block mode can fail into a long block mode when a virtual block becomes unhealthy or its health is undetermined.

19. The method of claim 11, wherein the health of a virtual block is represented by a single bit.

20. The method of claim 11, wherein the physical block is a section of track between insulated joints.

* * * * *